US008043153B2

(12) United States Patent
Ross et al.

(10) Patent No.: US 8,043,153 B2
(45) Date of Patent: Oct. 25, 2011

(54) GAMING DEVICE HAVING DESTRUCTIVE CHAIN REACTION EVENTS

(75) Inventors: Mark Ross, Las Vegas, NV (US); Gene Bond, Las Vegas, NV (US); Jay DeGarmo, Las Vegas, NV (US); Aimin Cong, Las Vegas, NV (US); Rolland N. Steil, Las Vegas, NV (US)

(73) Assignee: IGT, Reno, NV (US)

( * ) Notice: Subject to any disclaimer, the term of this patent is extended or adjusted under 35 U.S.C. 154(b) by 950 days.

(21) Appl. No.: 11/318,343

(22) Filed: Dec. 23, 2005

(65) Prior Publication Data

US 2007/0149267 A1 Jun. 28, 2007

(51) Int. Cl.
*A63F 9/24* (2006.01)

(52) U.S. Cl. ..... 463/16; 463/20

(58) Field of Classification Search ..... 463/16–20, 463/27, 29

See application file for complete search history.

(56) References Cited

U.S. PATENT DOCUMENTS

| | | | |
|---|---|---|---|
| 4,448,419 | A | 5/1984 | Telnaes |
| 4,764,666 | A | 8/1988 | Bergeron |
| 4,982,618 | A | 1/1991 | Culver |
| 5,280,909 | A | 1/1994 | Tracy |
| 5,770,533 | A | 6/1998 | Franchi |
| 5,823,874 | A | 10/1998 | Adams |
| 5,848,932 | A | 12/1998 | Adams |
| 5,855,514 | A | 1/1999 | Kamille |
| 6,015,346 | A | 1/2000 | Bennett |
| 6,089,976 | A | 7/2000 | Schneider et al. |
| 6,089,978 | A | 7/2000 | Adams |
| 6,102,798 | A | 8/2000 | Bennett |
| 6,149,156 | A | 11/2000 | Feola |
| 6,155,925 | A | 12/2000 | Giobbi et al. |
| 6,159,095 | A | 12/2000 | Frohm et al. |
| 6,159,097 | A | 12/2000 | Gura |
| 6,159,098 | A | 12/2000 | Slomiany et al. |
| 6,174,235 | B1 | 1/2001 | Walker et al. |
| 6,190,255 | B1 | 2/2001 | Thomas et al. |
| 6,203,429 | B1 | 3/2001 | Demar et al. |
| 6,217,448 | B1 | 4/2001 | Olsen |
| 6,234,897 | B1 | 5/2001 | Frohm et al. |

(Continued)

FOREIGN PATENT DOCUMENTS

GB 2 403 428 1/2005

OTHER PUBLICATIONS http: gscentral.net/board.htm "Press Your Luck Homepage".*

(Continued)

*Primary Examiner* — David L Lewis
*Assistant Examiner* — Eric M Thomas
(74) *Attorney, Agent, or Firm* — K&L Gates LLP

(57) ABSTRACT

In accordance with a game method, game information regarding one or more player selectable elements and awards associated with those elements is generated and stored. The player selectable elements are displayed and a player is permitted to select one or more of those elements. Each selected element is destroyed, unmasking or triggering an associated award. The award may be a monetary or credit value, symbol or secondary event. A secondary event may comprise an explosion or chain reaction destruction of other un-selected elements, which elements are unmasked to reveal associated awards or trigger additional secondary events. The game may be presented on a gaming machine, and may comprise a primary game or bonus round of another game.

49 Claims, 12 Drawing Sheets

U.S. PATENT DOCUMENTS

| | | | |
|---|---|---|---|
| 6,251,013 | B1 | 6/2001 | Bennett |
| 6,261,177 | B1 | 7/2001 | Bennett |
| 6,270,411 | B1 | 8/2001 | Gura et al. |
| 6,309,300 | B1 | 10/2001 | Glavich |
| 6,315,664 | B1 | 11/2001 | Baerlocher et al. |
| 6,319,124 | B1 | 11/2001 | Baerlocher et al. |
| 6,322,309 | B1 | 11/2001 | Thomas et al. |
| 6,334,814 | B1 | 1/2002 | Adams |
| 6,346,043 | B1 | 2/2002 | Colin et al. |
| 6,364,767 | B1 | 4/2002 | Brossard et al. |
| 6,375,570 | B1 | 4/2002 | Poole |
| 6,394,902 | B1 | 5/2002 | Glavich et al. |
| 6,413,161 | B1 | 7/2002 | Baerlocher et al. |
| 6,439,995 | B1 | 8/2002 | Hughs-Baird et al. |
| 6,443,837 | B1 | 9/2002 | Jaffe et al. |
| 6,450,883 | B1 | 9/2002 | O'Halloran |
| 6,494,785 | B1 | 12/2002 | Gerrard et al. |
| 6,506,118 | B1 | 1/2003 | Baerlocher et al. |
| 6,511,375 | B1 | 1/2003 | Kaminkow |
| 6,514,141 | B1 | 2/2003 | Kaminkow et al. |
| 6,517,432 | B1 | 2/2003 | Jaffe |
| 6,554,704 | B2 | 4/2003 | Nicastro et al. |
| 6,558,254 | B2 | 5/2003 | Baerlocher et al. |
| 6,561,900 | B1 | 5/2003 | Baerlocher et al. |
| 6,565,433 | B1 | 5/2003 | Baerlocher et al. |
| 6,565,436 | B1 | 5/2003 | Baerlocher |
| 6,569,016 | B1 | 5/2003 | Baerlocher |
| 6,572,472 | B1 | 6/2003 | Glavich |
| 6,582,306 | B1 | 6/2003 | Kaminkow |
| 6,582,307 | B2 | 6/2003 | Webb |
| 6,585,591 | B1 | 7/2003 | Baerlocher et al. |
| 6,595,854 | B2 | 7/2003 | Hughs-Baird et al. |
| 6,599,185 | B1 | 7/2003 | Kaminkow et al. |
| 6,602,135 | B1 | 8/2003 | Gerrard |
| 6,602,136 | B1 | 8/2003 | Baerlocher et al. |
| 6,602,137 | B2 | 8/2003 | Kaminkow et al. |
| 6,605,000 | B2 | 8/2003 | Adams |
| 6,605,001 | B1 | 8/2003 | Tarantino |
| 6,607,437 | B2 | 8/2003 | Casey et al. |
| 6,609,974 | B2 | 8/2003 | Mead et al. |
| 6,616,142 | B2 | 9/2003 | Adams |
| 6,620,046 | B2 | 9/2003 | Rowe |
| 6,632,139 | B1 | 10/2003 | Baerlocher |
| 6,632,140 | B2 | 10/2003 | Berman et al. |
| 6,632,141 | B2 | 10/2003 | Webb et al. |
| 6,634,943 | B1 | 10/2003 | Baerlocher |
| 6,634,945 | B2 | 10/2003 | Glavich |
| 6,645,073 | B2 | 11/2003 | Lemay et al. |
| 6,645,074 | B2 | 11/2003 | Thomas et al. |
| 6,648,754 | B2 | 11/2003 | Baerlocher et al. |
| 6,648,757 | B1 | 11/2003 | Slomiany et al. |
| 6,663,489 | B2 | 12/2003 | Baerlocher |
| 6,666,766 | B2 | 12/2003 | Baerlocher et al. |
| 6,672,960 | B1 | 1/2004 | B-Jensen |
| 6,676,516 | B2 | 1/2004 | Baerlocher et al. |
| 6,685,560 | B1 | 2/2004 | Hughes |
| 6,688,975 | B2 | 2/2004 | Baerlocher et al. |
| 6,692,356 | B2 | 2/2004 | Baerlocher et al. |
| 6,702,675 | B2 | 3/2004 | Poole et al. |
| 6,719,632 | B2 | 4/2004 | Palmer et al. |
| 6,722,981 | B2 | 4/2004 | Kaminkow et al. |
| 6,722,982 | B2 | 4/2004 | Kaminkow et al. |
| 6,726,565 | B2 | 4/2004 | Hughs-Baird |
| 6,731,313 | B1 | 5/2004 | Kaminkow |
| 6,733,386 | B2 | 5/2004 | Cuddy et al. |
| 6,739,971 | B2 | 5/2004 | Devaull |
| 6,746,327 | B2 | 6/2004 | Frohm et al. |
| 6,749,504 | B2 | 6/2004 | Hughs-Baird |
| 6,758,747 | B2 | 7/2004 | Baerlocher |
| 6,761,632 | B2 | 7/2004 | Bansemer et al. |
| 6,769,983 | B2 | 8/2004 | Slomiany |
| 6,776,711 | B1 | 8/2004 | Baerlocher |
| 6,780,105 | B1 | 8/2004 | Kaminkow |
| 6,780,107 | B2 | 8/2004 | Baerlocher et al. |
| 6,780,111 | B2 | 8/2004 | Cannon et al. |
| 6,783,457 | B2 | 8/2004 | Hughs-Baird et al. |
| 6,793,578 | B2 | 9/2004 | Luccesi et al. |
| 6,796,901 | B2 | 9/2004 | Baerlocher |
| 6,796,904 | B2 | 9/2004 | Yoseloff |
| 6,817,943 | B2 | 11/2004 | Gerrard |
| 6,817,944 | B2 | 11/2004 | Kaminkow et al. |
| 6,824,467 | B2 | 11/2004 | Schlottmann et al. |
| 6,837,793 | B2 | 1/2005 | McClintic |
| 6,843,722 | B2 | 1/2005 | Webb |
| 6,855,054 | B2 | 2/2005 | White et al. |
| 6,875,108 | B1 | 4/2005 | Hughs-Baird |
| 6,896,361 | B2 | 5/2005 | Sharpless et al. |
| 6,899,620 | B2 | 5/2005 | Kaminkow et al. |
| 6,905,405 | B2 | 6/2005 | McClintic |
| 6,910,962 | B2 | 6/2005 | Marks et al. |
| 6,918,832 | B2 | 7/2005 | Baerlocher et al. |
| 6,932,701 | B2 | 8/2005 | Glavich et al. |
| 6,939,223 | B1 | 9/2005 | Jones |
| 6,958,013 | B2 | 10/2005 | Miereau et al. |
| 6,966,833 | B2 | 11/2005 | Kaminkow et al. |
| 6,981,635 | B1 | 1/2006 | Hughs-Baird et al. |
| 6,986,709 | B2 | 1/2006 | Hughs-Baird et al. |
| 6,988,947 | B2 | 1/2006 | Baerlocher et al. |
| 6,991,538 | B2 | 1/2006 | Cannon |
| 7,037,191 | B2 | 5/2006 | Rodgers et al. |
| 7,040,984 | B2 | 5/2006 | Mead |
| 7,056,213 | B2 | 6/2006 | Ching et al. |
| 7,056,214 | B2 | 6/2006 | Miereau et al. |
| 7,070,505 | B2 | 7/2006 | Vancura et al. |
| 7,074,127 | B2 | 7/2006 | Cuddy et al. |
| 7,081,050 | B2 | 7/2006 | Tarantino |
| 7,090,580 | B2 | 8/2006 | Rodgers et al. |
| 7,094,148 | B2 | 8/2006 | Baerlocher et al. |
| 7,104,888 | B2 | 9/2006 | Miereau et al. |
| 7,112,137 | B2 | 9/2006 | Baerlocher et al. |
| 7,121,942 | B2 | 10/2006 | Baerlocher |
| 7,160,186 | B2 | 1/2007 | Cuddy et al. |
| 7,160,188 | B2 | 1/2007 | Kaminkow et al. |
| 7,162,036 | B2 | 1/2007 | Rowe |
| 7,169,044 | B2 | 1/2007 | Baerlocher et al. |
| 7,172,506 | B2 | 2/2007 | Baerlocher et al. |
| 7,175,523 | B2 | 2/2007 | Gilmore et al. |
| 7,182,689 | B2 | 2/2007 | Hughs-Baird et al. |
| 7,192,348 | B2 | 3/2007 | Brosnan et al. |
| 7,203,841 | B2 | 4/2007 | Jackson et al. |
| 7,235,011 | B2 | 6/2007 | Randall et al. |
| 7,264,545 | B2 | 9/2007 | Maya et al. |
| 7,273,415 | B2 | 9/2007 | Cregan et al. |
| 7,281,977 | B2 | 10/2007 | Jones |
| 7,300,348 | B2 | 11/2007 | Kaminkow et al. |
| 7,303,469 | B2 | 12/2007 | Kaminkow |
| 7,311,598 | B2 | 12/2007 | Kaminkow et al. |
| 7,311,604 | B2 | 12/2007 | Kaminkow et al. |
| 7,314,409 | B2 | 1/2008 | Maya et al. |
| 7,316,609 | B2 | 1/2008 | Dunn et al. |
| 7,331,862 | B2 | 2/2008 | Rodgers et al. |
| 7,331,866 | B2 | 2/2008 | Rodgers et al. |
| 7,338,367 | B2 | 3/2008 | Kaminkow et al. |
| 7,338,369 | B2 | 3/2008 | Mierau et al. |
| 7,351,141 | B2 | 4/2008 | Rodgers et al. |
| 7,371,168 | B2 | 5/2008 | Bilyeu et al. |
| 7,371,169 | B2 | 5/2008 | Baerlocher |
| 7,371,170 | B2 | 5/2008 | Cregan et al. |
| 7,371,174 | B2 | 5/2008 | Baerlocher |
| 7,377,849 | B2 | 5/2008 | Baerlocher et al. |
| 7,413,510 | B2 | 8/2008 | Schlegel et al. |
| 7,427,236 | B2 | 9/2008 | Kaminkow et al. |
| 7,500,913 | B2 | 3/2009 | Baerlocher |
| 7,500,914 | B2 | 3/2009 | Rodgers et al. |
| 7,500,915 | B2 | 3/2009 | Wolf et al. |
| 7,507,155 | B2 | 3/2009 | Mead et al. |
| 7,544,129 | B2 | 6/2009 | Baerlocher |
| 7,547,252 | B2 | 6/2009 | Peterson et al. |
| 7,566,271 | B2 | 7/2009 | Hostetler et al. |
| 7,578,735 | B2 | 8/2009 | Frizzell et al. |
| 2002/0052232 | A1 | 5/2002 | Kaminkow |
| 2003/0064794 | A1 | 4/2003 | Mead et al. |
| 2003/0069060 | A1* | 4/2003 | Seelig et al. ..... 463/17 |
| 2003/0130025 | A1* | 7/2003 | Gilmore et al. ..... 463/16 |
| 2003/0153378 | A1 | 8/2003 | Schlegel et al. |
| 2004/0048649 | A1 | 3/2004 | Peterson et al. |
| 2004/0053669 | A1 | 3/2004 | Gerrard |

2004/0110555 A1* 6/2004 Devaull et al. ..... 463/20
2004/0127279 A1* 7/2004 Gatto et al. ..... 463/17
2004/0142738 A1 7/2004 Anderson et al.
2005/0033461 A1 2/2005 Gerrard et al.
2005/0054404 A1 3/2005 Baerlocher
2005/0054405 A1 3/2005 Baerlocher et al.
2005/0054415 A1 3/2005 Kaminkow et al.
2005/0054416 A1 3/2005 Hostetler et al.
2005/0054435 A1 3/2005 Rodgers
2005/0059446 A1 3/2005 Kaminkow
2005/0059456 A1 3/2005 Mead et al.
2005/0059461 A1 3/2005 Ching et al.
2005/0096123 A1 5/2005 Cregan et al.
2005/0101372 A1 5/2005 Mierau et al.
2005/0119043 A1 6/2005 Berman
2005/0153769 A1 7/2005 Casey et al.
2005/0192081 A1 9/2005 Marks et al.
2005/0282615 A1 12/2005 Englman et al.
2006/0025195 A1 2/2006 Pennington
2006/0025196 A1 2/2006 Webb et al.
2006/0030401 A1 2/2006 Mead et al.
2006/0040732 A1 2/2006 Baerlocher
2006/0068882 A1 3/2006 Baerlocher et al.
2006/0073874 A1 4/2006 Cregan et al.
2006/0084494 A1 4/2006 Belger
2006/0084500 A1 4/2006 Baerlocher et al.
2006/0111170 A1* 5/2006 Hornik et al. ..... 463/16
2006/0205473 A1* 9/2006 Gomez et al. ..... 463/16
2006/0246977 A1 11/2006 Cannon
2007/0021194 A1 1/2007 Aida
2007/0021196 A1 1/2007 Campbell et al.
2007/0032285 A1 2/2007 Wolf
2007/0054732 A1 3/2007 Baerlocher
2007/0054733 A1 3/2007 Baerlocher
2007/0060314 A1 3/2007 Baerlocher et al.
2007/0060321 A1 3/2007 Vasquez et al.
2007/0077990 A1 4/2007 Cuddy
2007/0105619 A1 5/2007 Kniesteadt
2007/0105620 A1 5/2007 Cuddy et al.
2007/0155484 A1 7/2007 Walker
2007/0167217 A1 7/2007 Kaminkow
2008/0102916 A1 5/2008 Kovacs
2008/0113771 A1 5/2008 Baerlocher
2008/0139274 A1 6/2008 Baerlocher
2008/0153564 A1 6/2008 Baerlocher
2008/0176619 A1* 7/2008 Kelly et al. ..... 463/25
2008/0176625 A1* 7/2008 Kelly et al. ..... 463/25

OTHER PUBLICATIONS

"Minesweeper (Computer game)"; Wikipedia, the Fee Encylopedia; http://en.wikipedia.org/wiki/Minesweeper; 2007.

* cited by examiner

GAMING DEVICE HAVING DESTRUCTIVE CHAIN REACTION EVENTS

FIELD OF THE INVENTION

The invention relates to methods of playing and presenting games and gaming machines and systems for implementing these methods.

RELATED ART

Currently, gaming devices such as slot machines installed on casino floors have targeted revenue projections. These revenue projections are based on each machine's expected performance. A machine's performance is measured by the total hold from the intake of cash/vouchers during a combination of rate of play and duration of play. It is desirable to entice players into prolonged play so that slot machines may achieve or exceed their revenue projections.

Recently, slot machines have become more sophisticated and often feature advanced graphics, sounds and animations. Therefore, slot machines may be configured to offer compelling combinations of wagering models and entertainment models or themes which may promote extended game play. Such combinations of entertainment and wagering models may provide a sense of excitement, drama and anticipation to players. Furthermore, slot machine providers may be more competitive when they are able to differentiate their slot machines from their competitors with new combinations of wagering models and entertainment models or themes.

When slot machine games are configured with secondary bonus games different wagering models and entertainment combinations may be readily offered to players. By entering a secondary bonus game, a player may be offered the opportunity to increase winnings and also player choices that potentially appear to change game outcome. Therefore, a secondary bonus game may improve a player's gaming experience and may lead to extended game play.

While various secondary bonus games are known, many of them are common-place themes which players may have grown accustom. For example, secondary bonus games involving spinning wheels are well known. In bonus games involving wheels the potential winning amounts are generally posted on the wheel located above the machine which spins in a circular motion. In such a bonus round, the award is determined by which of the positions the wheel stops rotating. While such bonus rounds have proven popular, players may desire other types of bonus events.

The apparatus and methods described below overcome drawbacks in current wagering games.

SUMMARY

The invention comprises methods of presenting and playing games, and apparatus and systems for presenting the games, including gaming machines. In one embodiment, the games are played as wagering type games.

In accordance with one method, game information regarding a plurality of player selectable elements and awards associated with those elements is generated and stored. The awards may comprise monetary or credit values or amounts, special symbols, or secondary events.

The plurality of player selectable elements is displayed and a player is permitted to select one or more of those elements. For each player input or selection which is received, a destruction of the selected element is displayed. As described below, any type of destruction may occur. As part of the aftermath of the destruction, a monetary or credit award, or symbols is associated with the destroyed selectable element, which is preferably displayed and awarded to the player. In the event a secondary event, such as an explosion or chain reaction of the destruction of other un-selected elements is associated with the destroyed selected element, that event is displayed. That secondary event may comprise the display of the destruction of one or more elements, and the display of associated awards (or further secondary events).

Another embodiment of the invention is a method of playing a gaming machine having at least one wagering game. Game element data and associated awards or events are generated by or provided to a controller of the machine. In response to selections of game elements by a player, awards are unmasked or secondary events are triggered. In one embodiment, a secondary event may comprise a chain reaction of the unmasking of other game elements, such as in the form of a simulated pyrotechnic event in which adjacent and/or remote displayed game elements are destroyed. In one embodiment, the game information is displayed on one display and non-game entertainment information which is themed to the game is displayed on a secondary display concurrently with the game information.

In one embodiment the method and apparatus disclosed herein may be embodied on a gaming machine which comprises at least one display, at least one player selection or input device, and at least one controller. In this embodiment the gaming machine controller may be configured to generate game information itself, or process game information provided from a remote source. The remote source may comprise any location or device capable of generating game or bonus round data and providing such information or data to the gaming machine. In one example environment, the remote source comprises a central server configured to provide game content to a gaming machine configured as a terminal. The gaming machine is further configured to display a wagering game information in the form of one or more player selectable elements, to receive input from a player of one or more selected inputs, to display a destruction of the selected elements, and to display an award or secondary event associated with the destroyed element(s).

The gaming machine may be a stand-alone machine or be associated with a remote server (such as in an Internet or other distributed environment). A remote game server may take the form of a system where the random number generator used to decide game outcomes is located on the server as opposed to the terminal or machine where the game is played. In a system configuration, multiple gaming machines may be configured to present the game, and various of the awards may be progressive awards generated by wagers placed at the machines of the system.

Other systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE DRAWINGS

The components in the figures are not necessarily to scale, emphasis instead being placed upon illustrating the principles of the invention. In the figures, like reference numerals designate corresponding parts throughout the different views.

DETAILED DESCRIPTION

In the following description, numerous specific details are set forth in order to provide a more thorough description of the present invention. It will be apparent, however, to one skilled in the art, that the present invention may be practiced without these specific details. In other instances, well-known features have not been described in detail so as not to obscure the invention.

One embodiment of the invention comprises methods of playing and presenting a game. The game may be played in any environment and using any apparatus, such as at a computer or via the Internet. To aid in understanding, the game as discussed is presented at a gaming machine. In one embodiment, the game includes a main or base portion and a bonus or secondary portion.

1. Gaming Device

Figure 1:
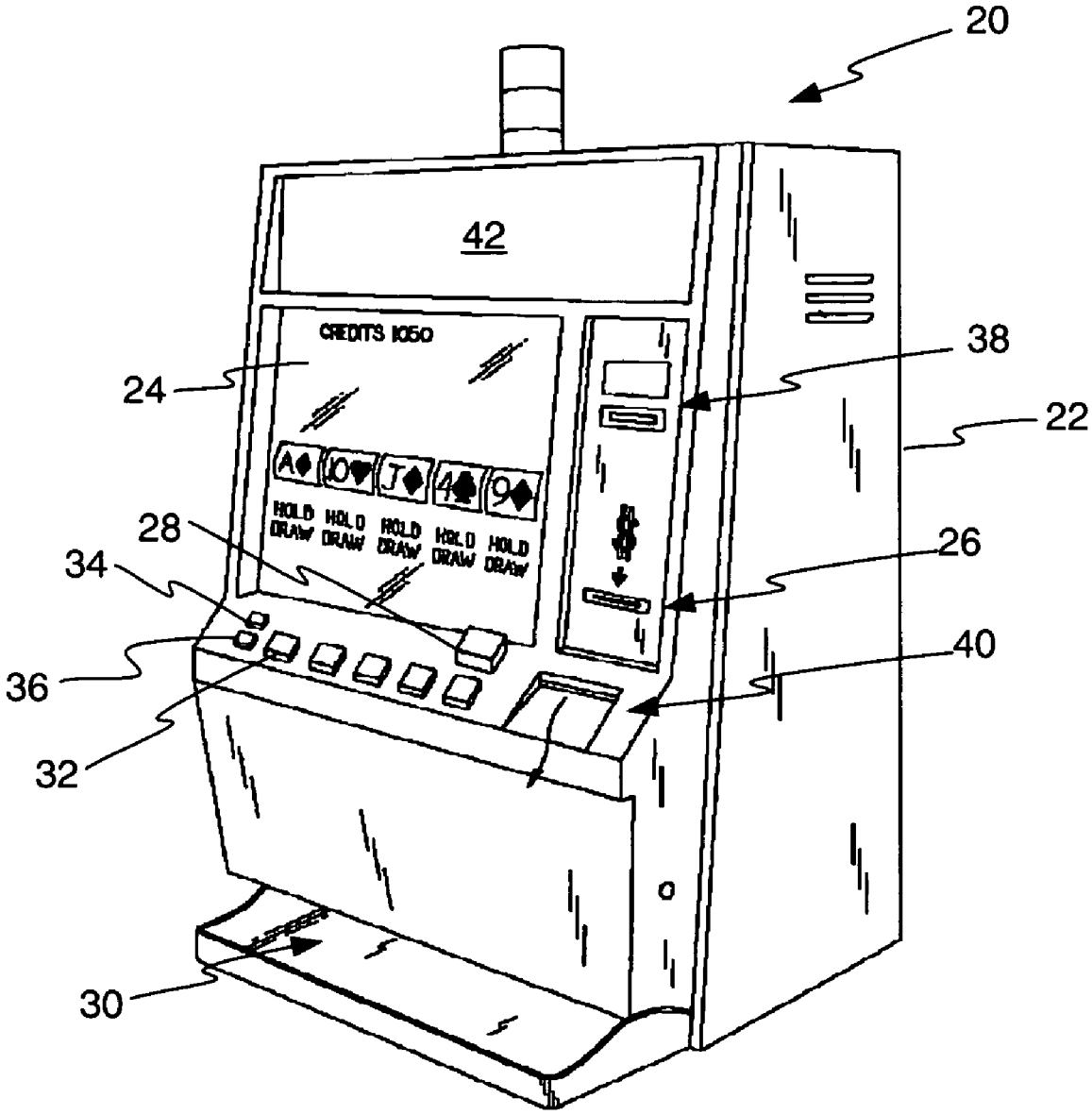
FIG. 1 illustrates a perspective view of an example embodiment of a gaming device in accordance with the present disclosure.

FIG. 1 illustrates one embodiment of a gaming machine 20 at which a game of the invention may be presented. As illustrated, the gaming machine 20 includes a housing 22 for enclosing/supporting various components of the gaming machine. The housing 22 have a variety of configurations. In one embodiment, the housing 22 is configured to the machine has an "upright" configuration. The machine 20 might also be configured as a "slant"-type, "bar-top" or have other forms.

In one embodiment, the gaming machine 20 is configured as a "video" type gaming machine, the machine including at least one display 24 for displaying game information to a player. As described below, this game information may include playing card symbols or indicia. The display may be of a variety of types, including CRT, LCD, plasma and others. As described below, the gaming machine 20 may also include more than one video display, or combinations of video displays and other display or presentation devices. It is also contemplated that reels may be utilized for presenting a base game, such as in a traditional slot machine configuration. The reels may be physical or displayed on a monitor.

The gaming machine 20 may include other means for providing information to a player. For example, speakers (not shown) or other devices may be provided for generating sound associated with the game. The gaming machine 20 may also include lights, printed instructions and other displays/display devices.

In one embodiment, a player must make payment in order to be entitled to play the game. Preferably, the game is presented as a wagering type game, and a player must place a bet or wager in order to play the game for the opportunity to receive winnings. If the player is a winner of the game, the player is provided an award, such as a monetary payout (such as coins), credits representing monetary value, points or tangible prizes. As illustrated, the gaming machine 20 may include a bill validator/acceptor 26 for accepting paper currency and a coin acceptor 28 for accepting coins. Other means of payment, such as a credit card reader, may be provided. An award of winnings in the form of coins may be paid to the player via a coin tray 30.

Preferably, the gaming machine 20 includes means for a player to provide input. In one embodiment, this means comprises one or more buttons. For example, a plurality of "hold" buttons 32 may be provided for permitting a player to hold/select cards in a hand or to freeze reels. A "bet one" button 34 and "bet max" button 36 are provided for a player to select the amount to bet on a particular game. Other means of input may be provided, such as a touch-screen display, keypad, joystick, and/or other devices now known or later developed.

In one embodiment, the gaming machine 20 may include one or more physical or video reels capable of displaying symbols. In such a configuration, means are provided for rotating the physical reels. In one or more embodiments, the means may comprise a mechanical linkage associated with a spin arm, with movement of the spin arm (a "pull") by a user causing the reels to spin. In such an arrangement, the reels are generally allowed to free-wheel and then stop. In another embodiment, electronically controlled mechanisms are arranged to rotate and stop each reel. Such mechanisms are well known to those of skill in the art. In this arrangement, actuation of the spin arm or depression a spin button causes a controller (not shown) to signal the activation of the spin mechanism associated with one or more of the reels. Preferably, the controller is arranged to either turn off the signal to the device(s) effecting the rotation of each or all of the reels or generates a signal for activating a braking device, whereby the reels are stopped. As is well known, the combinations of reel positions and their odds of hitting are associated with the controller, and the controller is arranged to stop the reels in a position displaying a combination of indicia as determined by the controller based on the combinations and odds. The principal of such an arrangement is described in U.S. Pat. No. 4,448,419 to Telnaes, which is incorporated herein by reference.

The gaming machine 20 may have other configurations, including other features. For example, the gaming machine 20 may include a player tracking device 38 such as a card reader and associated keypad. Such player tracking devices are well known and may permit the game operator to track play of players of the gaming machine (such as by information transmitted from the gaming machine back to a central server).

In one embodiment, the gaming machine 20 may be configured to dispense media, such as printed paper tickets, which have associated value, from a ticket dispenser 40. For example, winnings or unused credits may be returned to the player via a printed ticket having value or associated value. In one embodiment, the gaming machine 20 might also be configured to accept such media for providing credit for game play. Such systems are well known and thus not described in detail herein. The gaming machine 20 may also be configured to accept and issue or write to other types of media, such as magnetic stripe cards and smart cards.

In one embodiment, the gaming machine 20 is configured with both a main display 24 and one or more secondary displays 42. The secondary display 42 may be configured to display a wide variety of information, including graphics, text and the like. In a preferred embodiment of the invention, the main display 24 is configured to display main or base game information, and the secondary display 42 is configured to display bonus or secondary game information. In another embodiment, the main display 24 ma be configured to display game information and the secondary display 42 may be configured to display additional game information or non-game information, such as an entertainment event. In one embodiment, for example, when the main display 24 is displaying game information of a rock band theme, the secondary display 42 may be configured to display actual or simulated images of a rock band, such as a video clip, graphics or the like.

While the game of the invention is preferably played as a wagering game offering the possibility for monetary winnings, the game may be presented or played in other fashions. For example, the game may be played for fun or prizes. As such, the player may be permitted to play the game for free or may be required to make payment to play the game. Instead of being awarded monetary winnings (or representations thereof, such as credits which may be redeemed for representative monies), the player may be awarded points, tokens, physical goods, discounts and other value.

As indicated above, a player may provide value to the gaming machine 20 or machine operator in a number of ways, including with coins or bills. The player might also be permitted to provide value remotely. Value provided to the gaming machine 20 may be represented as credits. Each credit may have an associated monetary value.

Once the player provides value, the player preferably places a wager to play the game. This may be accomplished, in one embodiment, by the player pressing the "bet one" button 34 or the "bet max" button 36, or by other means.

Figure 2:
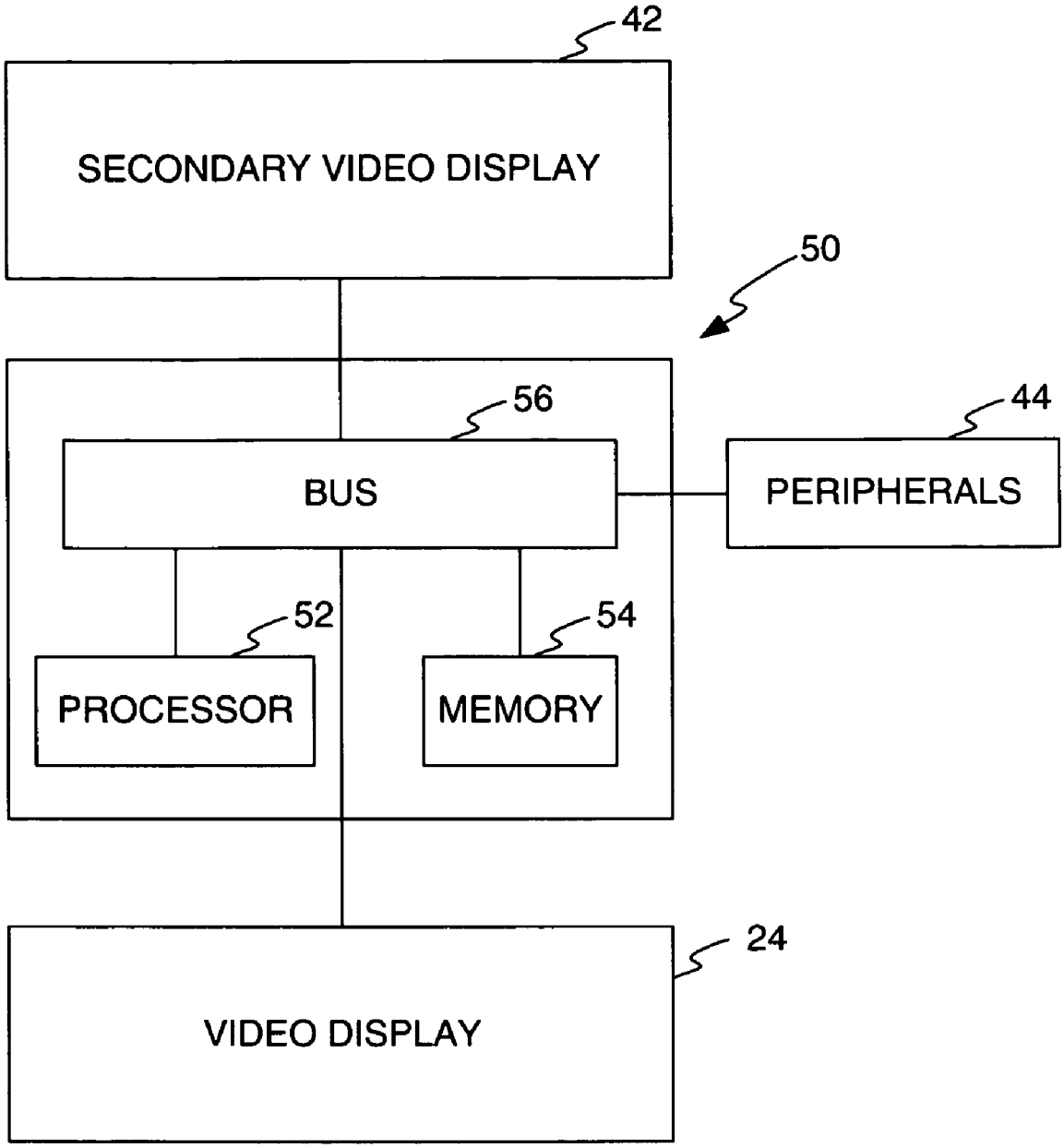
FIG. 2 illustrates a block diagram of a system for implementing the present invention.

FIG. 2 illustrates a master gaming controller 50 of a preferred embodiment of the gaming machine 20. In general, the master gaming controller 50 is configured to generate information for controlling the operation of the gaming machine 20, including various peripheral devices 44, as for receiving input from various sources, such as input from the buttons 32, 34, 36.

In one embodiment, the controller 50 includes a processor or processing device 52. In general, the processing device comprises a device capable of executing readable program code or data. In another embodiment, the processing device may comprise hardware which embodies the program code or data. In a preferred embodiment, program code for use by the processing device 52 may be stored in a memory 54 or other data/information storage device. The processing device 52 and memory 54 are in communication with one another. In one embodiment, the processing device 52 and memory 54 are linked by a common system bus 56.

As indicated, the controller 50 is configured to control various peripheral devices 44 of the gaming machine 20. As such, in a preferred embodiment, the processing device 52 is preferably capable of receiving information or data from the peripheral devices 44 and sending information or data, such as instructions, to those devices. As illustrated, in one or more embodiments, the peripheral devices 44 communicate with the processing device 52 via the bus 56. The other peripheral devices, such as the reels 24 and/or a video display 24 and a secondary display 42 are coupled to the bus 56.

In one embodiment, one or more speakers (not shown) may also be associated with the controller 50. In one embodiment, during play of a game, speakers driven by the controller 50 may present audible win information. In another embodiment, speakers may present thematic entertainment such as music and/or other audible information drawing a player's attention to prompts, events and outcomes of the game.

In one embodiment, the master gaming controller 50 may be associated with a player tracking system or other system. For example, the master gaming controller 50 may be associated with a security or game service system. This system may include one or more remote devices, such as one or more remote servers, such as for generating and transmitting game implementing software or game outcomes. These devices may be placed in communication with the master gaming controller 50 via a communication interface at the gaming machine 20. The communication interface may couple to the bus 56. A communication link (not shown), such as a wired or wireless link, is provided between the communication interface and the remote device, such as a communication interface of a remote server.

It will be appreciated that in one or more embodiments, the gaming controller 50 of the gaming machine 20 is specifically configured to implement the method of the present invention. In this regard, machine readable program code may be provided, such as stored in memory, for this purpose. In another embodiment, the processor may be specifically configured to implement all or a portion of the method.

It will be appreciated that the gaming machine 20 may have a variety of configurations, and that the gaming machine 20 illustrated and described above is but an example of a device for implementing the game of the present invention. For example, in one or more embodiments, the gaming machine 20 may be associated with a network and receive game information remotely and may transmit information, such as payout and game play information, to a remote location. For example, a remote master controller may generate game information which is transmitted over a communication link to the gaming machine 20. That information may be utilized by a local controller or processor to present the game, such as by displaying game play data or information. The gaming machine 20 might also comprise a computer, such as a desktop or laptop computer, which computer might receive game information from a remote gaming server or controller over a communication link.

2. Game Play

An exemplary method of playing and presenting the game will now be described. In one embodiment, the game of the invention is played as a wagering type game. As detailed above, a player may provide value to the gaming machine 20 such as by inserting bills, coins, a coded ticket, credit card numbers, by transfer or credits or the like. In one embodiment, provided value is converted to one or more credits. The number of credits which belong to the player may be displayed on the display 24. The player may place a wager by one or more inputs to the "bet one" or "bet max" buttons 34, 36. Of course, other means for accepting input of a wager may be utilized such as a touch-sensitive display.

Once the player places a wager, if one is required, a main or base game is presented to and played by a player. The main or base game may be initiated automatically after the player places a wager, or by other means, such as by a player pressing a "start," "deal," "spin" or other button or providing other game initiating input.

The base game may be any of a variety of games now known or later developed. Such games include, but are not limited to, various card games (such as video poker), dice games, games in Class II jurisdictions such as Oklahoma, mechanical reels, simulated slot games and other games or contests.

Preferably, the main game has a plurality of possible outcomes, at least one of which is declared to be a bonus game initiating outcome. In one embodiment, a plurality of the main game outcomes is declared to be main game winning outcomes. If the game is played or presented as a wagering game, winnings may be awarded for main game winning outcomes, such as in accordance with a paytable. The remaining outcomes may be declared non-winning or "losing" main game outcomes.

As indicated, at least one of the possible main game outcomes is a bonus game initiating outcome. In one embodiment, the bonus game initiating outcome may be one of the main game winning outcomes (though one or more of the bonus game initiating outcomes could instead or, in addition, be one of the main game losing outcomes). It is also possible to trigger the bonus portion or round of the game based upon events other than a particular outcome of the main or base game. The bonus portion may be triggered randomly or based upon a particular aspect of the base game. In one example, a bonus game may be triggered when a player receives a particular set of reel indicia, or card or cards in a game of video poker irrespective of whether a particular poker hand is winning or non-winning. It is also possible for the portion of the game described herein as the bonus game or round to be played as a stand-alone game, whether for wager or otherwise.

In the event the outcome of the main game is one of the bonus game initiating outcomes or the bonus game is otherwise triggered, the game preferably includes the presentation and play of at least one bonus game or event. In this embodiment, this secondary portion of the game is referred to as a "bonus" portion of the game because, in one embodiment, the player is permitted to play this portion of the game without additional wager and with the further opportunity to be awarded winnings.

One embodiment of a bonus event or bonus round portion of the game will now be described with reference to FIGS. 3A-3B. It will be appreciated that this is but one of numerous methods of playing a bonus round portion of the game and that the method may be configured as a portion of a game exclusive of any bonus round.

Figure 3A:
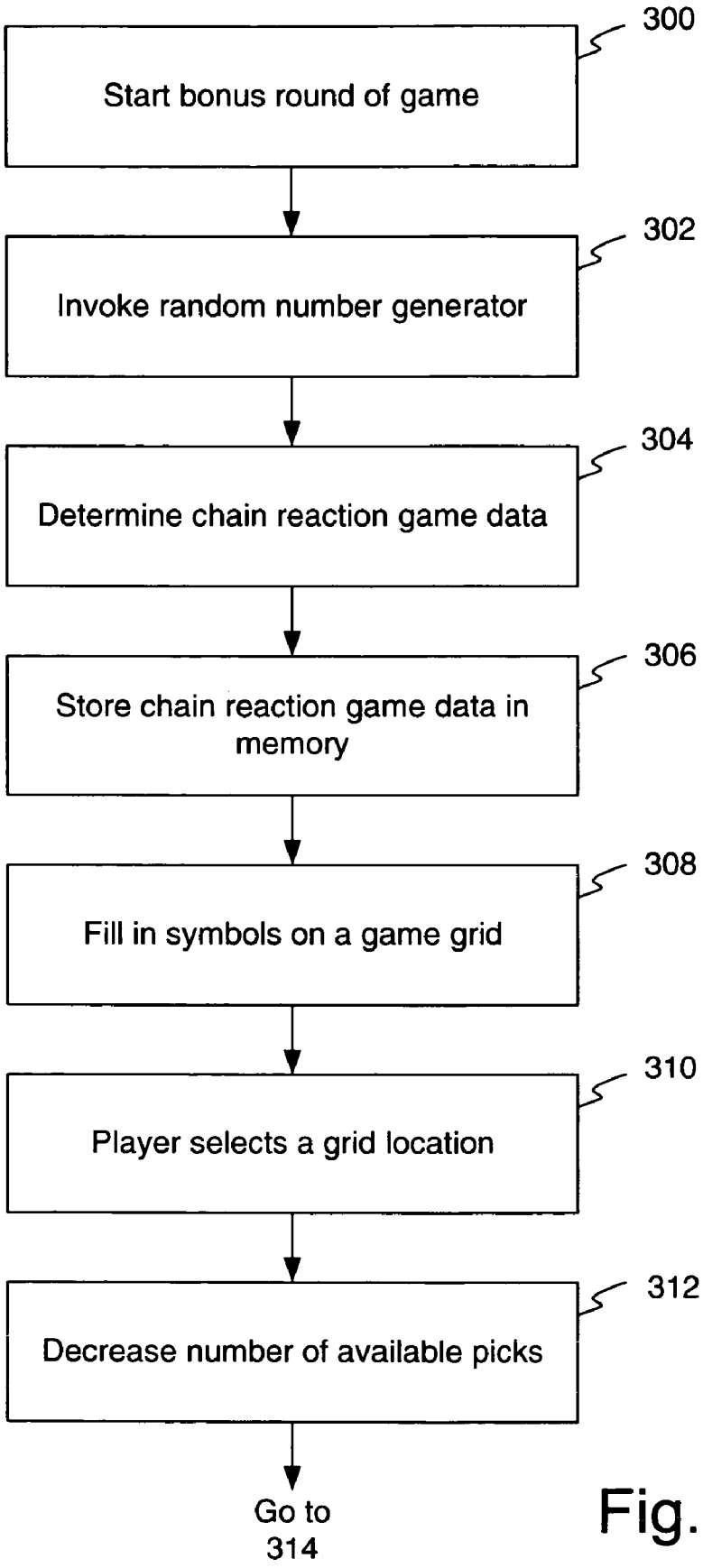
FIGS. 3A and 3B illustrate a flow diagram of an exemplary embodiment of a method of playing the game disclosed herein.

Referring to FIG. 3A, in step 300, the bonus round starts. Various information may be provided to the player to indicate the initiation of the bonus round, including music or other sounds, graphics and the like, such as for the purpose of raising the excitement level of the player.

In one embodiment, one or more bonus round outcomes are randomly generated. In accordance with this embodiment, in a step 302, a random number generator generates one or more random numbers. The random numbers may be generated, for example, by software code which is executed by a gaming machine processor or by a separate number generating element which is in communication with the processor. It is further contemplated that the random numbers or any game outcome may be generated at a remote site, such as by a server or other random number generator. Such an environment may comprise a central server environment. The random numbers or game outcomes may be communicated to the gaming machine, such as via a communication link.

In one embodiment, the bonus game may offer a player a selection of one or more elements or objects, such as options displayed by the bonus display 42. The player may select one or more of the elements. Each pick initiates one or more processor determined events which result in an unmasking or revealing of outcomes. These outcomes may be non-awards (i.e. "losing outcomes"), awards (such as specific monetary or credit values) or various secondary events. In one embodiment, a secondary event may comprise or trigger a chain reaction event where a number of additional elements are unmasked, the number and nature of which are preferably pre-determined. In one embodiment, chain reaction events are generated by the gaming machine based upon one or more generated random numbers and a proximity algorithm may be utilized to determine which other elements may be involved in chain reaction. The proximity algorithm comprises a algorithm that determines for one or more elements, which may be selected by a player, which other elements will be involved in the chain reaction. The proximity algorithm may select adjacent elements, available adjacent, random elements, or any combination thereof. In one embodiment, an unmasking, including any secondary event, such as a chain reaction event, is represented by one or more special effects directed toward stimulating the player. Examples of the type or manner of special effects may comprise but is not limited to any type of destructive event described herein.

To the player(s), the display of a first destructive event may trigger other secondary destructive events. The secondary destructive events may be triggered by the first destructive event, such as in a chain reaction manner. In one embodiment debris or an explosion from a destructive event may trigger the chain reaction. It is further contemplated that the type of destructive event would relate to a theme of the game, machine, or bonus round. By way of example if the theme is construction, then the destructive event may relate to demolition of a building. If the theme is a music concert, then the destructive event may comprise with stage pyrotechnic which provide an explosion on the stage. Of course and as would be appreciated by one of ordinary skill in the art, any number of different themes with related or unrelated destructive events may be provided.

Preferably, each unmasking, including any secondary event, such as a chain reaction event, is represented by one or more, destruction, detonation or other special effects directed to stimulating the player. Example of the type or manner of destruction may comprise, but is not limited to, pyrotechnics, explosions, destruction, acidic corrosion, flying debris, domino style collapses, wrecking ball, nuclear explosion, demolition, implosion, electrical or lightning based destruction, or any combination of these element or any other destructive event that is presented to the player or other players or non-players. The debris may comprise any type of matter which may trigger other destructive events, of other screen items or player selectable elements. The debris may comprise, but is not limited to, any type of flying debris or explosion from destruction of a player selected element or a secondary destruction, shrapnel, missiles, falling or destroyed material, wind blasts, and projectiles.

During the course of unmasking events, the aftermath reveals an outcome such as one or more awards, non-awards, or special symbols are revealed to the player. The aftermath may be defined as a culminated effect of whatever happens after the destructive event. For example, if the player selection results in a destructive event, the aftermath would be the results after the explosion, and what remains on the screen after the destructive event. If the element selected by the player is an screen display of an audio speaker, then the aftermath may included the destroyed speaker, the award, non-award or special symbol that appears. The term aftermath may also be considered to be the consequences of the destructive event. In other embodiment any simulated object displayed on the screen may be subject to a destructive event as defined herein. Any other simulated object that is displayed may be subject to a destructive event which can be appreciated may depend on the theme of the game. For example, simulated object may comprise speakers, microphones, musical instruments, audio mixing boards, disco or spot lights, munitions, oil drums, grenades, bombs, volatile substances (gasoline, nitroglycerin, rocket fuel . . . ), dynamite, fuses or any other object as may shown on the display.

A special symbol comprises a symbol that is part of a puzzle or other bonus round goal or objective. Each player selection may decrease the number of available picks. The player may continue to select from remaining displayed options until there are no available picks or all possible options have been revealed. Alternatively, addition selection options may occur.

When a chain reaction event comprises one or more detonations or destructions, the detonations may have a pyrotechnic appearance. After each destruction a residue may be formed. The residue is termed an "aftermath". In one embodiment, the aftermath may reveal awards, non-awards or special symbols that are hidden by the pyrotechnic effect.

In a step 304, bonus game data is generated from the one or more random numbers. In one embodiment, the bonus game data comprises a number of player selections which the player will receive. It will be appreciated, however, that the number of picks or selections may be fixed or may be dependent wholly or in part upon other conditions, such as the frequency of a player's wager, wager amount, or by other criteria or factors. The bonus game data may also include a number of bonus game elements which can be triggered as a result of a player selection. In step 306 the generated bonus game chain reaction data is stored, such as in a memory of the gaming machine's controller (see FIG. 2 and description above). Based upon the generated data, the bonus game is then presented to the player.

In step 308, one or more of the generated symbols or other elements are displayed to the player for selection. The symbols or other elements may be displayed, for example, on the main display 24 or secondary display 42 of the gaming machine 20. In one embodiment, the symbols are distributed to selected locations of a grid (as described in more detail below), although in other embodiments the symbols may be located in any arrangement.

The symbols may be any form of indicia including, but not limited to alphanumeric letters, icons, animations and the like. Additionally, destruction markers may also be displayed, such as in association with a particular selection or distributed to selected locations of the grid to indicate chain reaction events. In other embodiments, elements other than destruction markers may be shown on the screen and utilized depending on the type of destruction that has occurred. Audio clips associated with the destruction markers and symbols may also be distributed to selected locations of the grid. The number of picks currently available to a player in a bonus round may be displayed to the player.

In step 310, the player selects a symbol or element, that is shown on the screen, such as via a location on the grid. The player may select the location by touching the gaming machine display or via other input, such as by activating a gaming machine button (see FIG. 1 and description above). The one or more inputs or selections are received by the gaming machine.

In step 312, the number of remaining picks displayed to the player may be decreased after the player's selection.

Figure 3B:
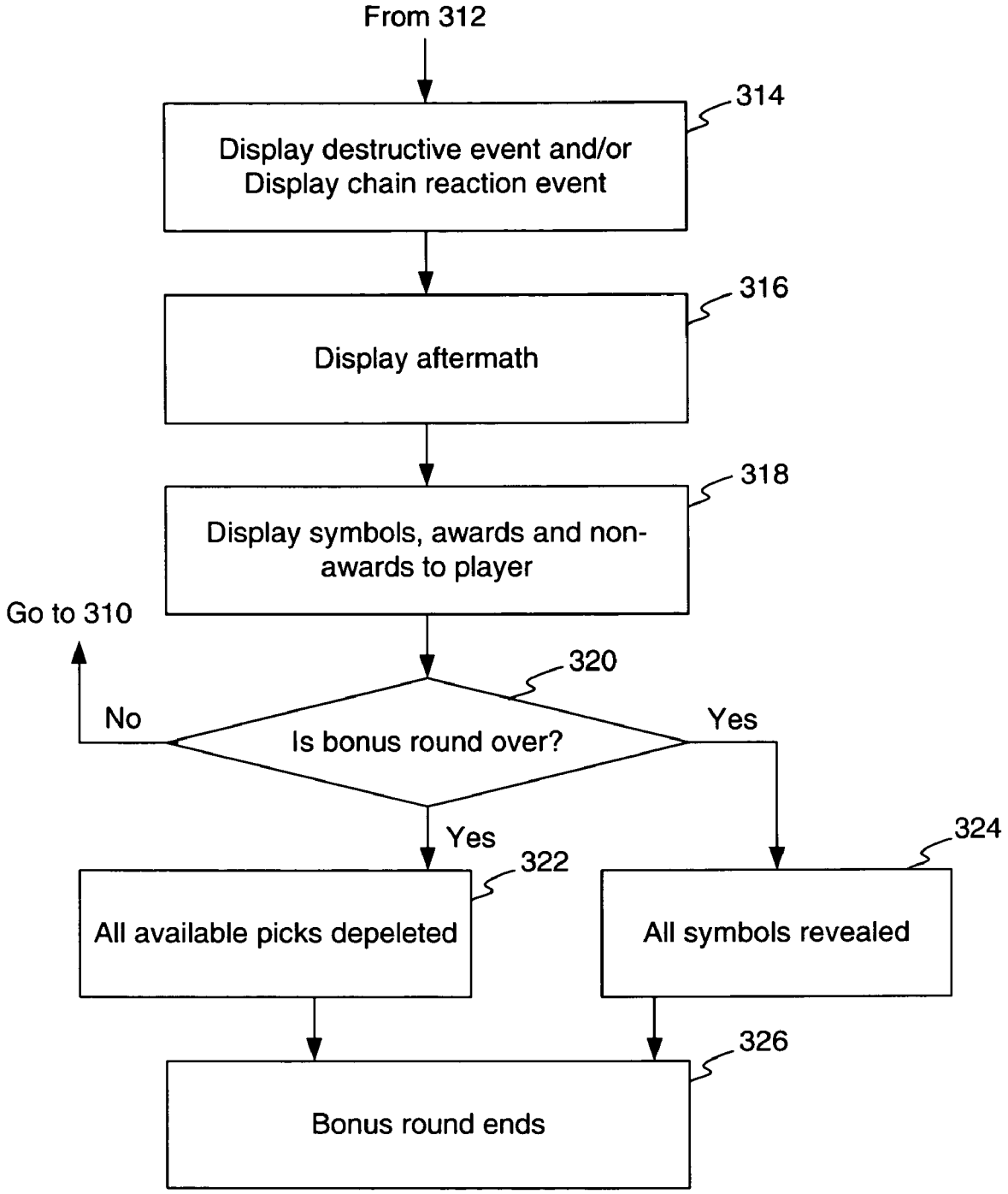

Referring now to FIG. 3B, in step 314 the location or element selected by the player (see above in step 310) may destroy itself, or may destroy itself and initialize a chain reaction event, depending upon whether the embodiment of the game includes such events. If the version of the game includes such events and one of those events was associated with the selected element, then that event may be initialized. In step 314, if such an event exists, the chain reaction event is displayed or broadcast to the player. In one embodiment, a chain reaction comprises an automatic selection of one or more additional elements, such as elements located adjacent to the player selected element or one or more elements located remote there from. As disclosed below, the selection of elements in such a secondary event may be by a "proximity algorithm," thus causing such events to vary based on the algorithm. In one embodiment, if the adjacent elements have already been selected and destroyed, then the next available adjacent element may be selected by the proximity algorithm.

In one embodiment, the proximity algorithm may select elements which are adjacent to the player pick, or adjacent but not yet destroyed or based on weighted selection. The selection weighting may be based on the proximity of other elements to the destroyed element. For example, when the player selects an element, the element may be destroyed. The destruction of the player selected element may result in the destruction of other elements such as by a chain reaction event. Which other elements are chosen for destruction in the chain reaction are or may be based on the location of the other elements. Elements which are close to the player selected element may be weighted with a higher likelihood of chain reaction destruction as compared to elements which are distant from the player selected element. The proximity algorithm may be configured to account for the proximity of other element to the player selected element during the selection of other elements in a chain reaction event.

In a step 316, the result of the player selection and any chain reaction event or aftermath, is preferably displayed. In one embodiment, this comprises the "destruction" of the one or more selected elements and any other elements which are destroyed by the chain reaction. For example, a simulated explosion or destruction, melting (such as by simulated heat, acid or the like) or other destruction of the elements is displayed. It will be appreciated a chain-reaction event is preferably displayed as a reaction or consequence of the destruction of a player selected element. It will also be appreciated that the triggering of other elements via a secondary event may similarly trigger additional secondary events, i.e. additional destructive events in the chain reaction. Stated another way, in one embodiment the player selection of an element or symbol may generate an explosion that reveals that symbol and also triggers secondary explosions, such as from the first blast, and the resulting flying debris explodes other selections to create secondary explosions. These secondary explosions may trigger additional explosions or destructive events and so on.

In step 318, the aftermath of the one or more elements preferably results in the display of one or more awards. Those awards may comprise monetary or credit value awards, non-awards (i.e. no win), special symbols, additional selections or the like.

In a step 320, it is determined if the bonus event or round is complete. This may be determined, for example, by the gaming machine processor evaluating the stored bonus game data. The bonus round may be completed in one or more ways. In a step 322, the bonus round may be completed if the player's number of allotted or awarded picks has decremented to zero.

Alternatively, in step 324 the bonus round may be completed when the player's selection of one or more symbols or elements (such as via selection of particular grid locations) reveals all symbols of a group of special symbols. The player may be awarded enhanced credits and/or awards and/or non-awards when all special symbols are revealed. Additionally, a finale destruction and/or a congratulatory event may be presented to the player, as detailed below.

Alternatively, if the bonus round is incomplete because neither the player's number of picks has been depleted nor all special symbols have been revealed, the gaming machine's processor may return to step 310 for another cycle of the bonus round. In step 326 the bonus round ends when steps 322 or steps 324 have occurred.

One example of a method of presenting and play will now be described with reference to FIGS. 4A-4H.

Figure 4A:
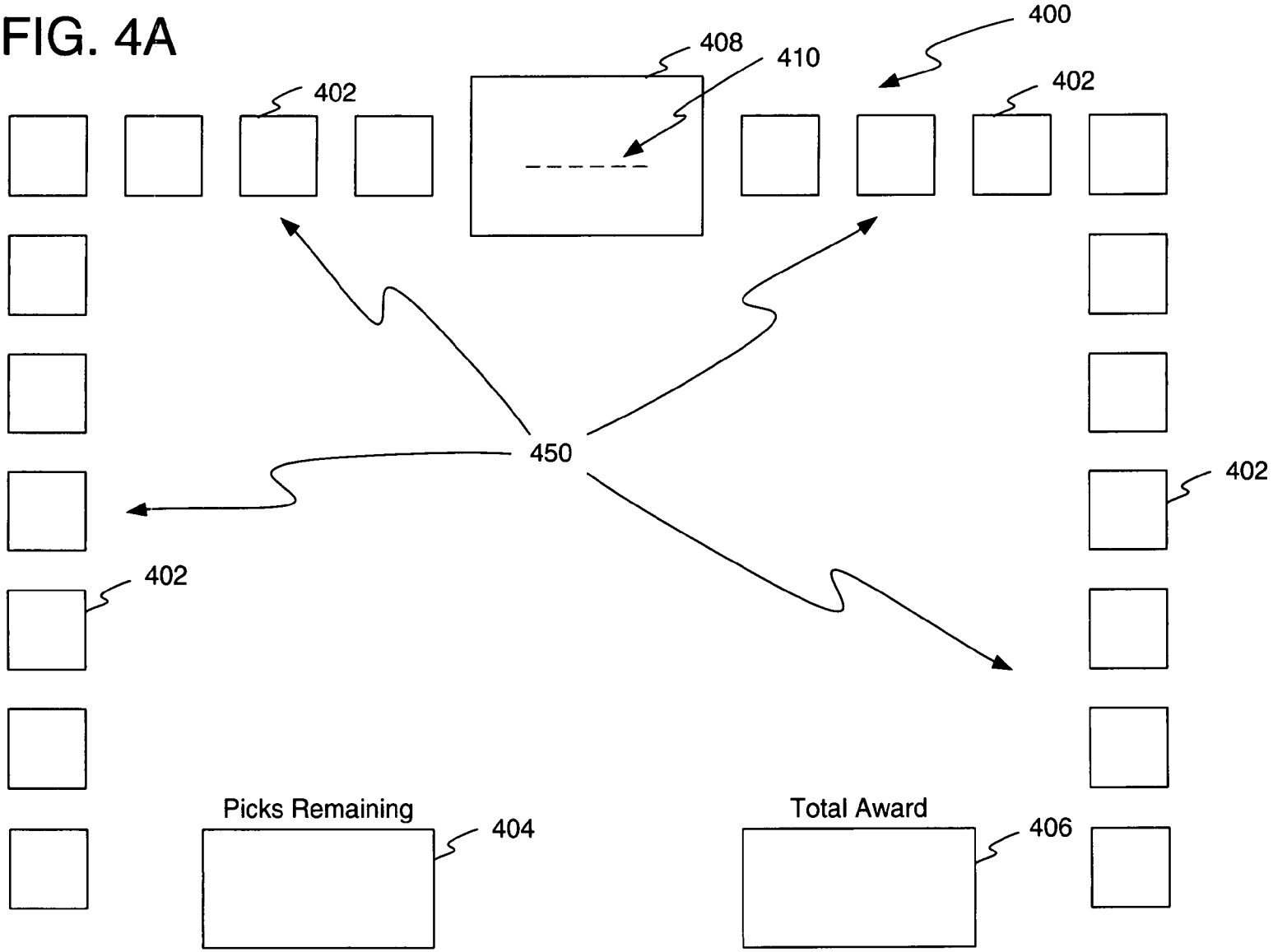
FIG. 4A illustrates one embodiment of displayed game information in accordance with a method of the invention.

FIG. 4A illustrates an exemplary embodiment of displayed game information, such as in the form of a bonus round display 400. As detailed above, the game may be played as a stand-alone game, or may be presented as a bonus round or portion of another game. As indicated above, when the game has a main game and a bonus portion, the bonus round display 400 may be displayed in response to a player receiving a particular outcome(s) of the main game. However, the bonus round display 400 could simply comprise a main game display when the game is played in stand-alone fashion.

The bonus round display 400 may be displayed, for example, graphically via one of the displays of the gaming machine 20 configured as detailed above. In one embodiment, as detailed above, main game information may be presented on the main display 24 of such a machine, and the bonus round display 400 may be displayed on the secondary display 42. In another embodiment, the game information is displayed on the main display 24 and secondary, non-game or "entertainment" information is displayed on the secondary display 42. This entertainment information or theme may comprise any entertainment for the players including but not, graphics of a theme of the game or a theme which is associated with the game, video or music from a concert, music video, television show, celebrity, radio, sporting event, film, play, reality show, or any other event, or any aspect of a video game such as concepts from known video games which are adopted into wagering environments such as but not limited to known video games or a known video game play mechanics such as breakout objectives, maze games, first person shooter, etc.

The display 400 may comprise one or more bonus game spots, locations or elements 402, a picks indicator 404 (denoted Picks Remaining in FIG. 4A), an awards indicator 406 (denoted Total Award in FIG. 4A), and a symbols display 408. The picks indicator 404 displays how many bonus round selections (picks) are or remain available to the player (such as via a numerical value). The awards indicator 406 displays how many credits and/or awards have been earned by the player, preferably during a bonus round of the game. The symbols display 408 displays symbols the player has uncovered during a bonus round of the game. It will be appreciated that this is but one configuration of the display 400. The description below provides operational details of features of the display 400.

When the bonus round is presented to a player, the player may be prompted to select one or more bonus spots or elements 402. The bonus spots or elements 402 may be configured in an array 450 as shown in FIG. 4A, or in any other manner, such as in random positions or other patterns. The game may display a total number of picks on the picks indicator 404 to permit the player to increase the player's credits and/or awards during the bonus round. Each time the player selects a bonus spot 402 the number of picks or selections displayed by the picks indicator 404 may be incremented, with the number of picks or selections decreased or increased depending on an outcome of the player's selection in the bonus game. Further, as the player accumulates more credits and/or awards, a number of credits displayed by the awards indicator 406 may also be incremented.

As indicated above, each game element preferably has an associated award or event. The award might be a monetary or credit value. The secondary event may be a chain-reaction or secondary triggering or selection of other elements.

In one embodiment, an award may comprise one or more special symbols. The special symbols may comprise any type symbol that provides an award other than credits or which are used to solve or complete a puzzle. These one or more special symbols may be coupled to the symbols display 408 and displayed on the symbol display when an element is selected directly by a player and then destroyed, or when additional elements are selected and destroyed in a secondary event. When the bonus round reveals a predetermined number of symbols to the player which are accumulated on the symbols display 408, the bonus game may award extra credits and/or awards to the player. The symbols display 408 may have one or more space holders 410 visible to the player so that the player may know how many special symbols are needed to complete all space holders or to solve the puzzle. It will be appreciated that the bonus game may award larger credits and/or awards to the player when all space holders 410 are complete. In one embodiment, for example, a player may attempt to unmask or reveal letters which collectively complete a game phrase, such as the letters K I S S (when the theme of the game is a rock band).

Figure 4B:
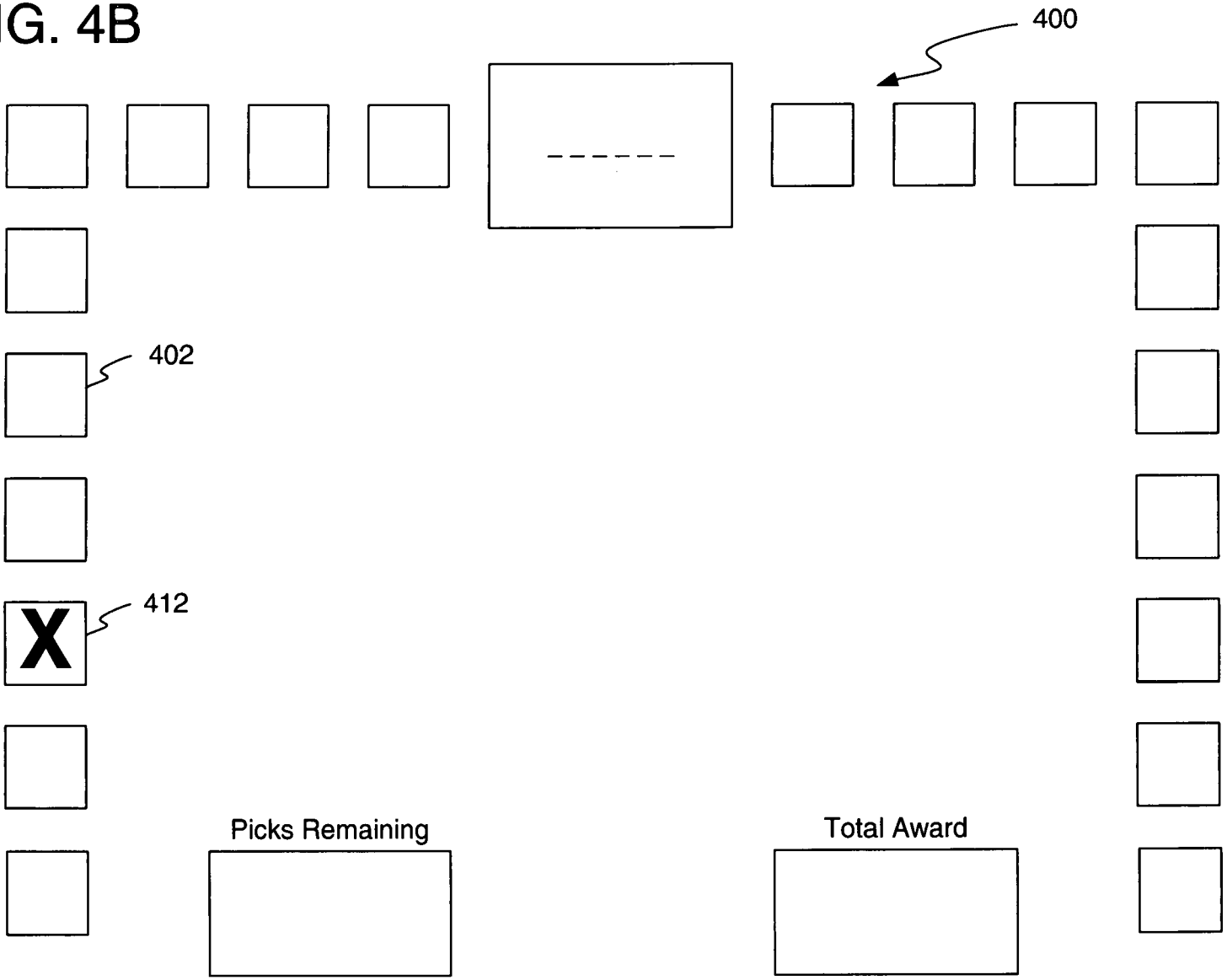
FIGS. 4B, 4C, 4D, 4E, 4F, 4G and 4H each illustrate additional views of displayed game information in accordance an example embodiment.

Turning now to FIG. 4B, and as described above, the gaming machine preferably pre-defines symbols, values or awards or events coupled to each bonus spot 402 of the bonus round display 300. The player may select a spot 412 (illustrated as X in FIG. 4B) by touching the display 400 or by touching a button of a gaming machine such as illustrated in FIG. 1 (see above). When the player selects spot 412, the processor receives a signal and may confirm selection of that spot 412, such as by presenting a visual confirmation, such as the "X" as depicted in FIG. 4B. In one embodiment, after the player selects any spot 412, the gaming machine may be configured to generate another bonus game including yet another set of bonus spots 402, and the like.

Figure 4C:
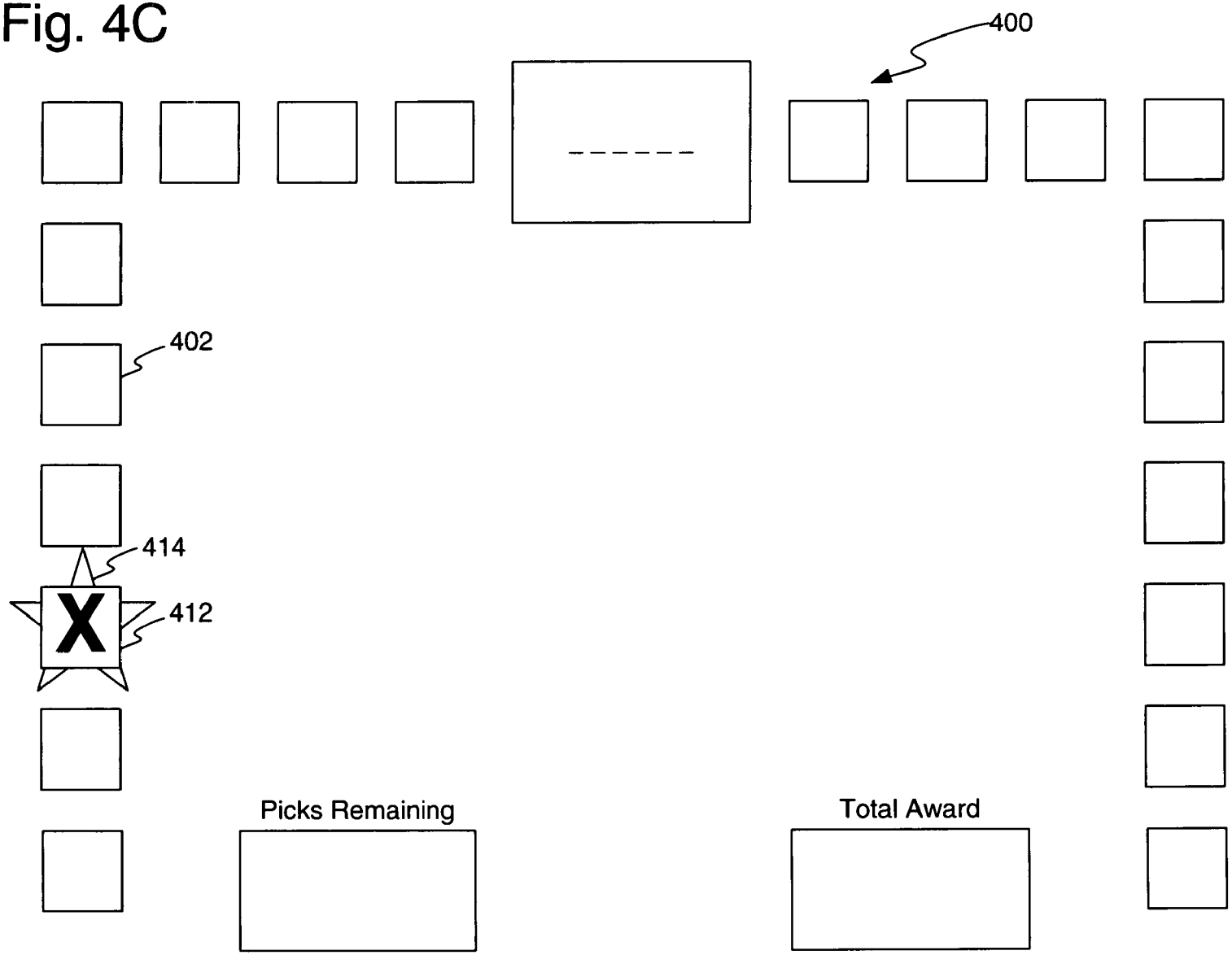

Referring to FIG. 4C, in a following step, the result of the player's selection is preferably "unmasked." In a preferred embodiment, this unmasking is via a destruction, such as destruction or other method, of the selected element. For example, a destruction event marker 414 (such as a star burst as depicted in FIG. 4C) may be displayed to the player after the player selects spot 412. The marker 414 may further generate illustrations of any kind of event associated with a theme of the main game or of the bonus game. Audible sounds associated with both the theme and the marker 414 may also be generated by the gaming machine's processor. The illustrations and audible sounds may add to a player's entertainment during the bonus round, and increase a player's desire to continue playing the game. The marker 414 may be destructive or non-destructive depending on the game's theme, but is preferably associated with an unmasking or revealing of the result of the player's selection. In one embodiment, for example, the selected area may graphically appear to explode, melt, dissolve, burn, or the like. Preferably, the result of this action is the display of the result of the selection, such as no or zero credits, a particular credit and/or award (such as one or more additional sections), or a special symbol.

Figure 4D:
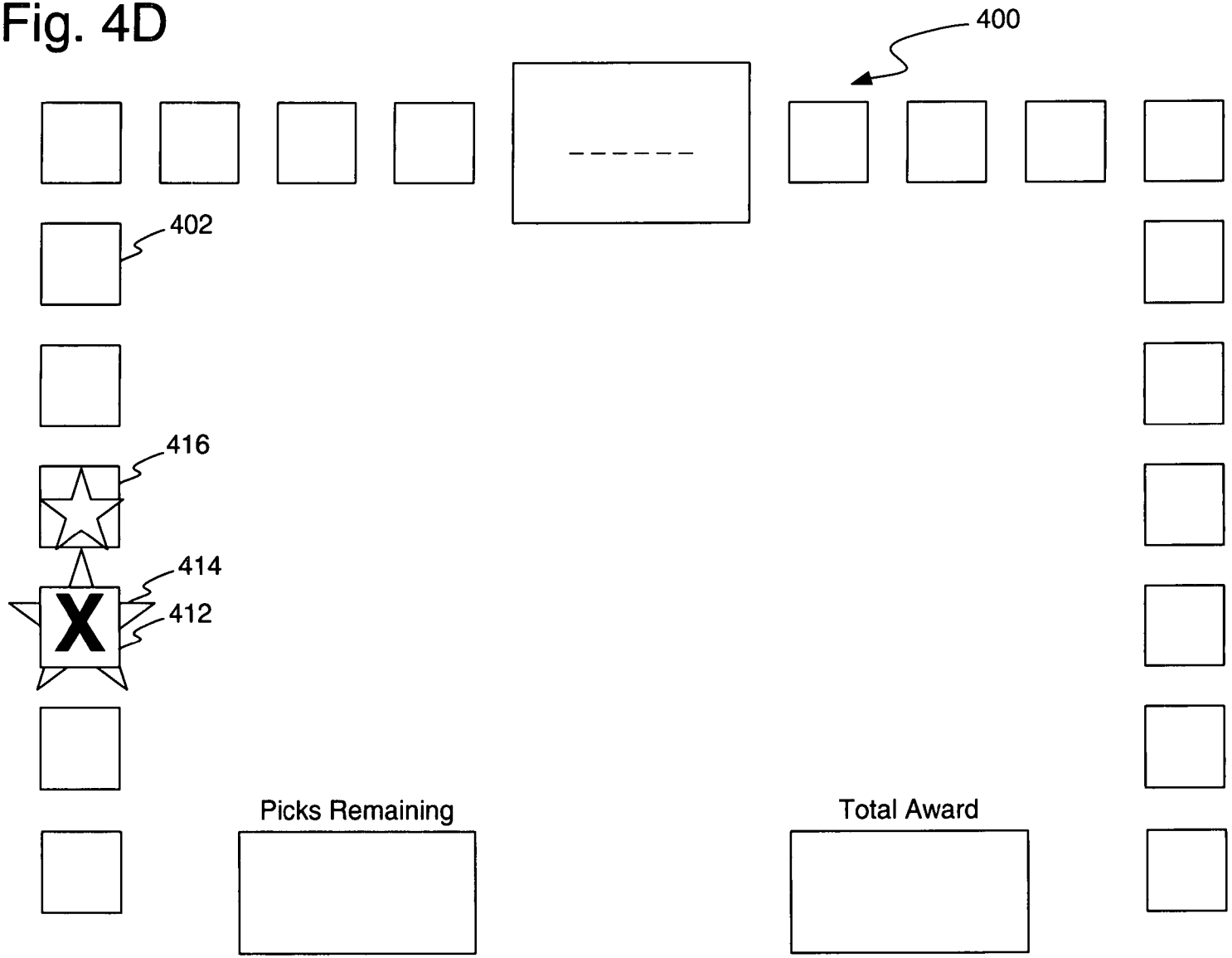

Referring to FIG. 4D, instead of a particular award, or in addition thereto, the selected element may have an associated secondary event. The secondary event may be a chain reaction which triggers the selection of one or more additional elements. Such an event may be represented by illustration or display of secondary destruction event markers 416 or other graphical depictions of destruction (depicted as a star burst in FIG. 4D). This visual representation may include accompanying audio, such as of an explosion, thunder clap or the like.

As detailed above, a chain-reaction selection or destruction of additional elements may be of adjacent and/or remote elements. The selection of which other elements or symbols to destroy during a secondary or subsequent destruction event may be random. In one embodiment, the destruction of one element may include the ejection or expulsion of debris, which depicted debris appears to trigger the destruction of the other elements in the chain reaction. A player may experience excitement and realistic sensations related to the theme from this combination of display and audio. In operation, software under the direction of the processor pre-defines all events such as the chain reaction described above. Once again, the display of the second marker 416 preferably results in an unmasking or revealing of the result of that selection, such as credits and/or awards.

Figure 4E:
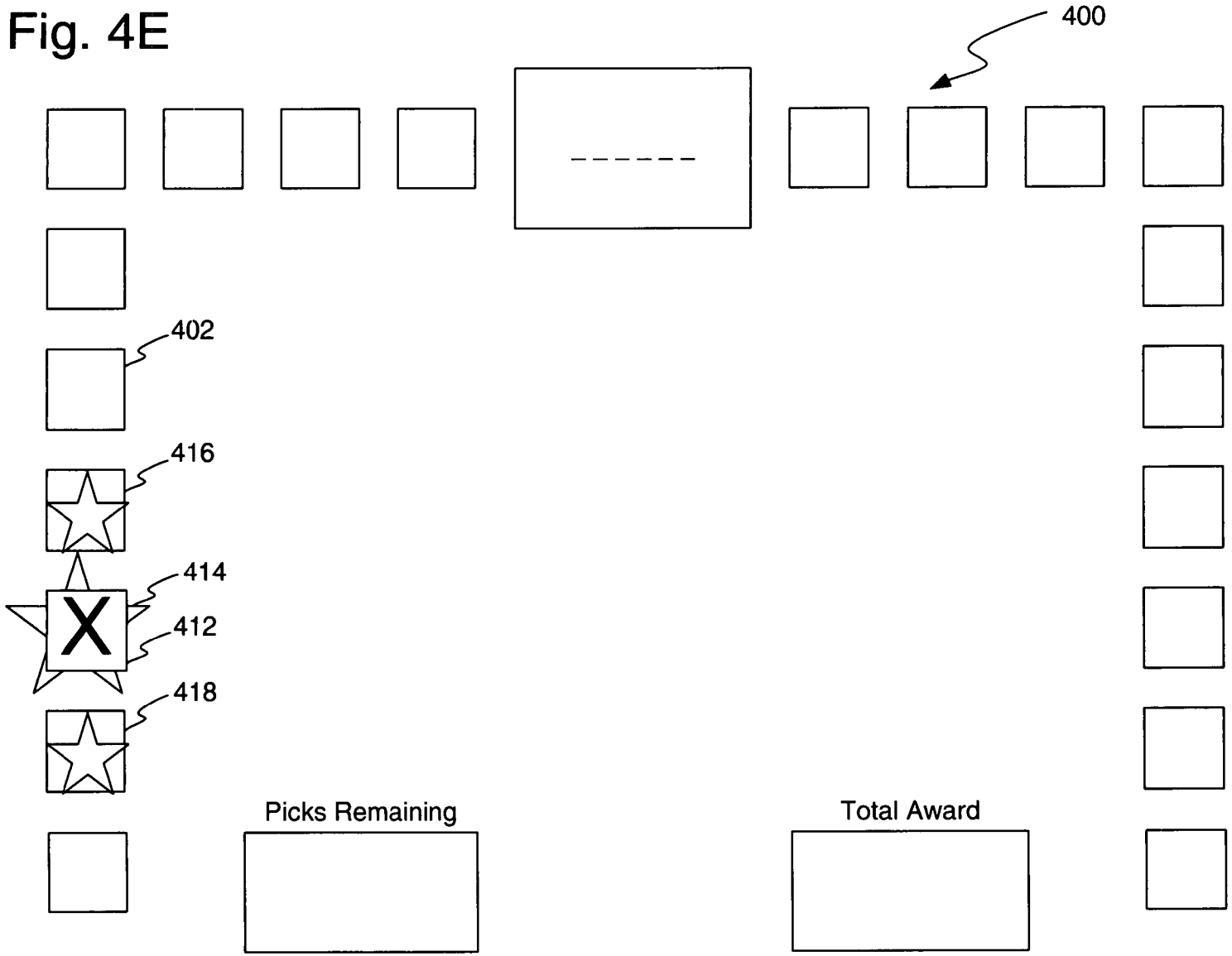
Figure 4F:
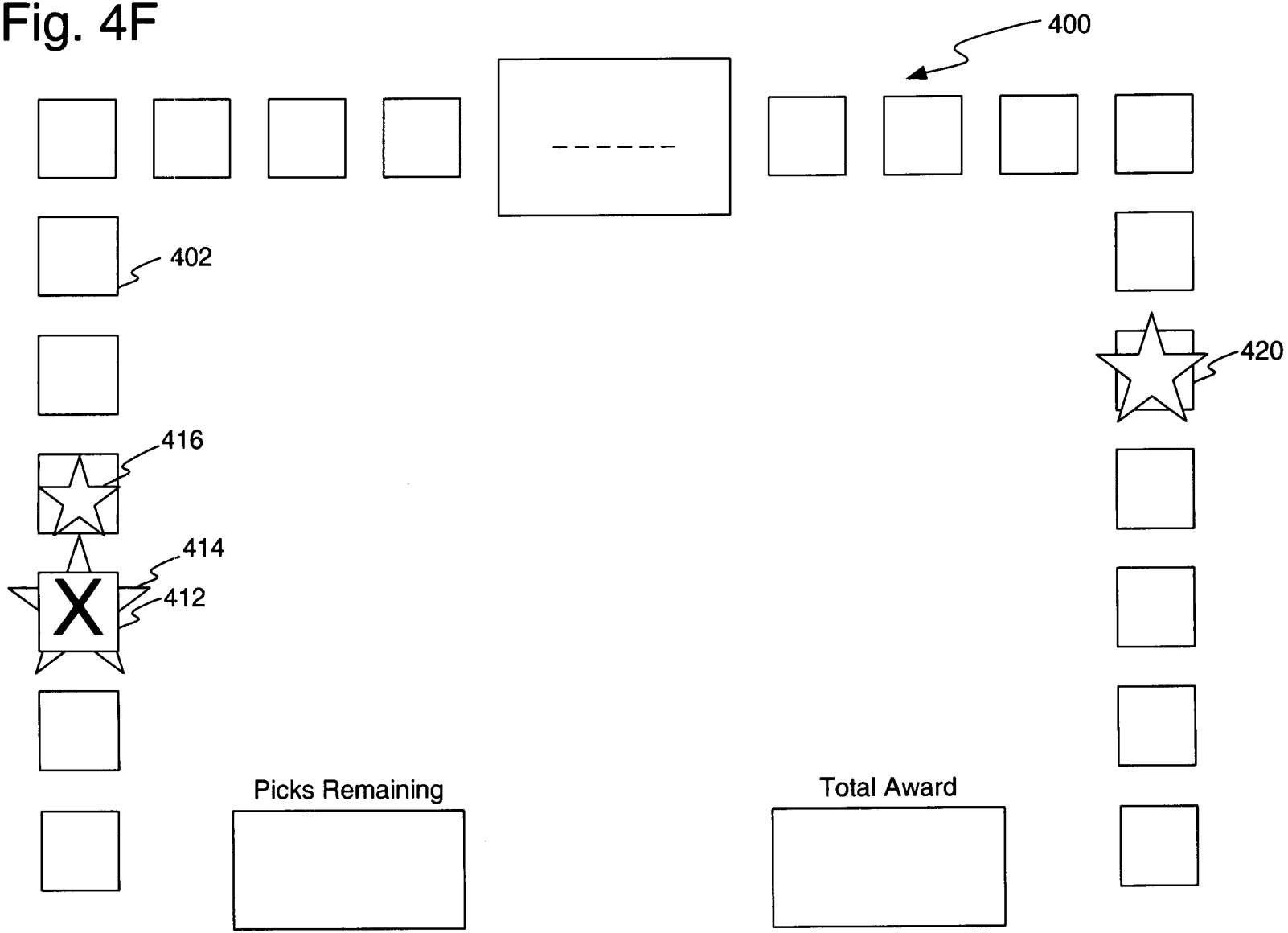

The second marker 416 may lead to a third destruction event marker 418 via another chain reaction as illustrated in FIG. 4E. In FIG. 4E the third marker 418 is shown as being adjacent to the marker 414. However, it will be appreciated that the second marker 416 and/or the third marker 418 may be located at any positions of the array 450 (see FIG. 4F and description below). For example, FIG. 4F illustrates an embodiment of a bonus game where a destruction event marker 420 is triggered or displayed remotely from an originating marker 414/416. It will be appreciated that an outcome of a "destruction" event at one location may be the "destruction" of one or more non-adjacent locations, as indicated by remote destruction markers 420. In this manner, the player experiences the results of an explosion or chain reaction defined by the player's initial selection of spot 412 (see above in FIG. 4B). The player's excitement may be enhanced since the player may have no preconception where the chain reaction may progress during the game. As described above, display or destruction associated with a non-adjacent marker 420 may also be accompanied with video and/or audio, and preferably results in the unmasking or revealing of an outcome, such as credits and/or awards.

Without limiting this disclosure, it will be appreciated that more or less than three destruction event markers may be displayed after the player initially selects marker 412. The processor may determine the number of destruction event markers by the size of the player's wager when entering the bonus round of the game, by the player's frequency of wagers and the like or combinations thereof.

Figure 4G:
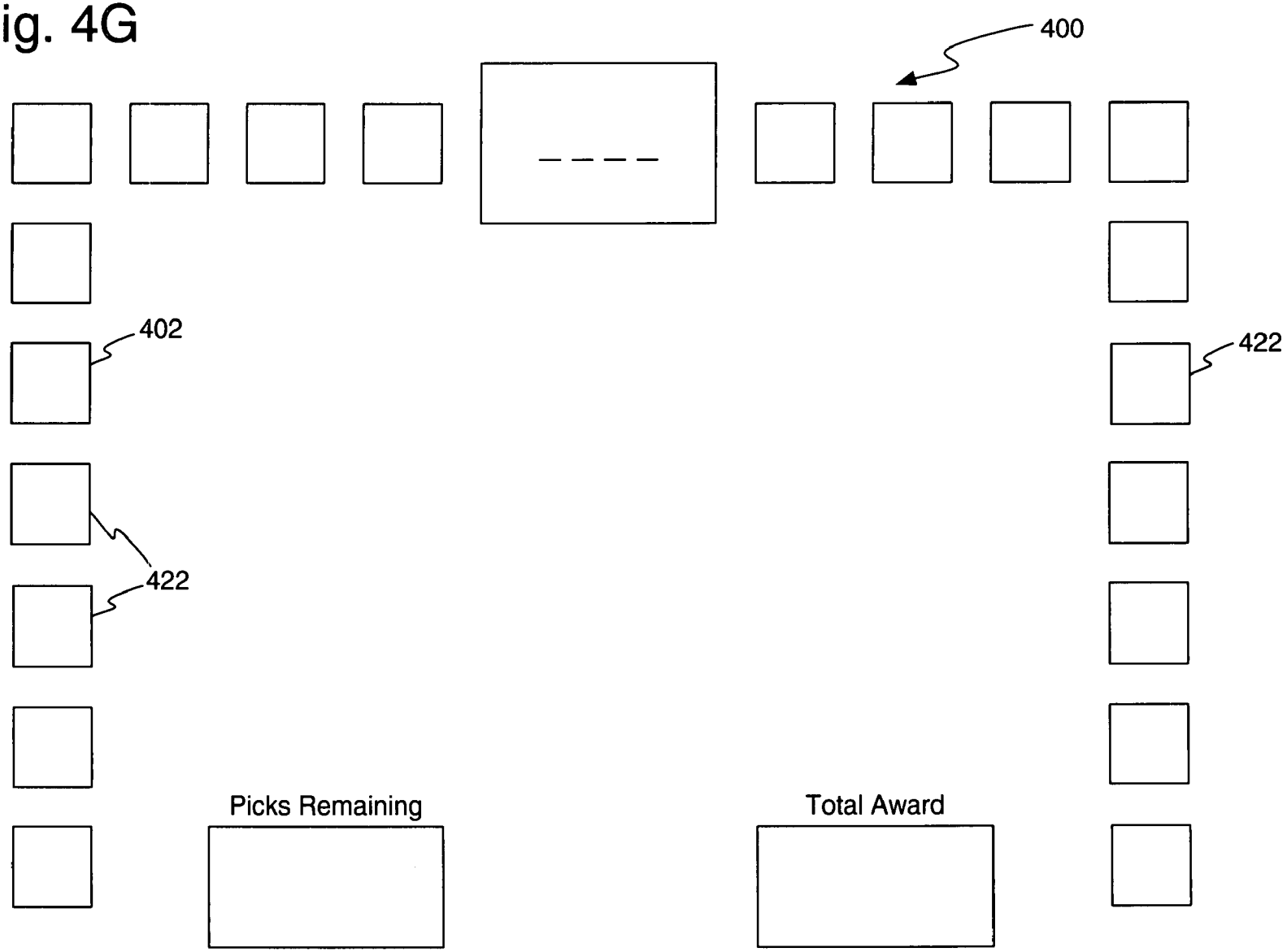

FIG. 4G illustrates the appearance of the display 400 after all chain reaction events, in this example round, have been presented to the player. The chain reaction leaves a residue or aftermath 422 of the chain reaction. The aftermath 422 may reveal or unmask a number of awards.

In one embodiment, a special reward symbol that is at least one of a collection of symbols may be exposed with the aftermath. Each discovery of a special reward symbol by the player may accumulate an award value associated with collecting the special reward symbols. Each special reward symbol found may result in additional destruction effects. Finding all special reward symbols may result in a concluding or finale set of destructions. It will be appreciated that the bonus game may, in one embodiment, distribute credits and/or awards after the aftermath occurs and all special symbols are revealed to the player. Furthermore, the game's bonus round may end when all special symbols are revealed to the player. If the game's bonus round does not reveal all special symbols to the player, the player's available picks, as the picks are used, are decremented until the player has no picks available and the game's bonus round may end. The end of the game's bonus round may return a player to the main game (see description above).

Figure 4H:
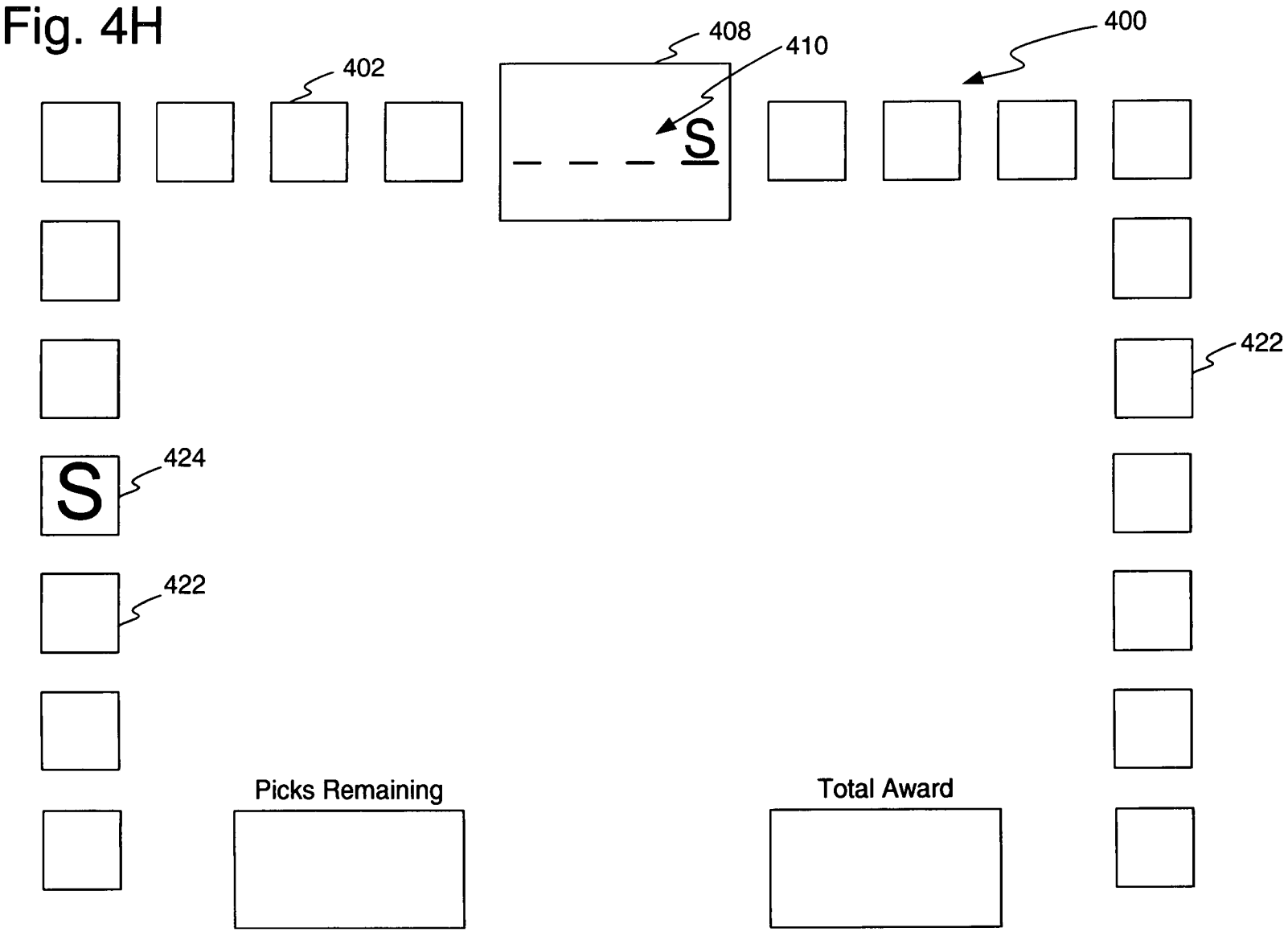

FIG. 4H illustrates the appearance of the display 400 after an aftermath 422 uncovers a special symbol such as the letter "S" in spot 424 of the array 450. According to FIG. 4H, the letter "S" is also shown in space holders 410 of the symbols display 408. It will be appreciated that one or more letters may be displayed to the player when the special symbol is uncovered, and furthermore that the letters may be displayed in space holders 410. The letter "S" may be one special symbol of a collection of special symbols as described above. The collection of special symbols may be associated with the theme of the game and collection of all special symbols may provide enhanced credits and/or awards to the player. If the aftermath 422 reveals all letters in space holders 410, the game's bonus round may conclude and the main game may be displayed to the player.

3. Additional or Alternative Embodiments of the Invention

As described above, the result of the unmasking or revealing of an award associated with a position may be an enhanced picks symbol. This symbol may award more picks for the player. These additional picks may increase the remaining number of bonus round picks available to the player and may extend the duration of the bonus game. Uncovering such a symbol may result in additional destruction or pyrotechnic effects.

The unmasking may reveal other awards or symbols, such as one or more of the following:

A promoter symbol may promote the player to another round or higher level of the bonus game. This additional round gives the player the opportunity to start another version of the bonus game where no previous picks have been selected. This may provide the player with an opportunity to pick and reveal awards of higher values.

A mystery symbol may trigger a mystery jackpot. The mystery jackpot may award an additional award pre-determined or randomly generated by the processor. The additional award may contribute to the player's overall winnings during the bonus round. The mystery jackpot may be calculated or triggered by a mystery controller or progressive controller.

To implement a mystery or progressive, the controller of the system may be modified such that at the beginning of each progressive game cycle it enables the gaming machine displays and/or overhead display to display the jackpot-win value which has been established for the game cycle. The controller of the system is additionally adapted so that the current jackpot value for a given progressive game cycle is also randomly established or lined to a player selection or number of elements destroyed. This can be effected for each game cycle by randomly selecting one or more parameters such as the increment rate and/or the base value, used to determine the current jackpot value.

With the controller so adapted, the players on the gaming machines are immediately made aware of the added jackpot they can win by playing on their respective machines. As a result, players are no longer presented with a low initial or base value which could cause them to not play at the beginning of the game cycle. Lessened play at this time is thus reduced. Also by randomly establishing the current jackpot value, it remains difficult for players to predict the number of unit bets needed to reach the displayed jackpot-win value. Thus, the unpredictable nature of the progressive game is preserved when implemented as a mystery.

In a further aspect of the present invention, a controller for the above type of system may be adapted to provide signaling information to a winning gaming machine so as to enable and cause, the machine to automatically provide the jackpot win value payout from the machine itself. With this modification, each gaming machine may be adapted to respond to signaling information. As a further aspect of this modification, payout need not be based on a jackpot-win value, but upon other predetermined conditions or criteria which determine the jackpot value.

In order to stimulate play on the gaming machines, a progressive jackpot system is utilized across a number gaming machines. This progressive system enables the players playing on the numerous machines to compete for an additional jackpot which is reached as a result of game play at the machines, but which is not won based upon winning at the machines. As shown, the system may include a programmed controller which links the machines and which establishes and controls the progressive jackpot. In the case shown, the system may also include a common display as well as individual displays or meters, which are located at the gaming machines, all of which display the same jackpot information received from the controller.

A special symbol or virtual symbol may award virtual credits to the player. Virtual credits may be defined as credits that may not be cashed out and have no direct monetary value. Virtual credits allow players to purchase items within the game such as to alter the game's theme, and/or introduce additional gaming propositions or models. When the game's theme is altered new graphics, animation, sound effects, music and the like may be provided by the processor to the player.

A free symbol may award free games or free spins to the player. Alternatively, when the bonus game concludes, the game may reveal a free spin mode derived from uncovering of the special symbol.

An entertainment symbol may distribute an "entertainment award" to the player. Such entertainment may heighten the drama/excitement of the game without increasing the player's winnings. Entertainment presented to the player may include one or more additional pyrotechnics, launching additional music, audio, animations and the like or any other entertainment discussed herein.

A proposal symbol may initiate an optional additional betting opportunity. Such a bet may offer an opportunity for the player to increase the player's winnings. Examples of betting opportunities or models include a Hi-Lo game, double or nothing and the like. When the optional wagering opportunity concludes the player may resume playing the bonus round.

A special awards symbol may allow the player to select an additional award from a group of special awards. Selecting the additional award may be configured so as to not deplete the remaining picks the player has left in the bonus game. After the selection of the additional award the player may resume playing the bonus round.

An auxiliary symbol may allow the player to select an auxiliary bonus game or round from a list of bonus games or rounds. The player may temporarily leave the current bonus game, enter another bonus game, accumulate an award, and upon completion of the auxiliary bonus game resume playing the original bonus round.

In one embodiment of the invention, two or more gaming machines configured to present the game or bonus round described herein may be linked and/or associated with a common or central server/controller. In such an embodiment, a jackpot symbol may be associated with a progressive bonus award. A jackpot may be accumulated from a portion of wagers of players of associated gaming machines, and all or a portion of that jackpot may be awarded when the jackpot symbol is unmasked. Alternatively, the jackpot symbol may contribute to an accumulating progressive bonus award and may be won as a top award depending on the number of jackpot symbols revealed.

In such a system of multiple machines, when a player enters the bonus round, each terminal associated with other players of the game may receive a notice alerting them that the bonus round has been initiated by a player. Additionally, when one or more players on the network receive the jackpot symbol, or only a particular symbol, from an aftermath during a bonus game, all other players may be alerted with a destruction event. The other players may share in the jackpot and may also view the destruction. The destruction event may lead to a further aftermath with subsequent results as described above, which may also be viewed by other players on displays associated with the other players. In yet another embodiment, after an aftermath has been displayed to a player during a bonus round, all other players may receive a network symbol awarding credits and/or awards to all players of the network game. In this manner, the bonus round becomes interactive between multiple machines.

While various embodiments of the invention have been described, it will be apparent to those of ordinary skill in the art that many more embodiments and implementations are possible that are within the scope of this invention.

What is claimed is:

1. A method of operating a gaming device, said method comprising:

causing a processor to generate game information including a plurality of player selectable elements and at least one award associated with at least one of the player selectable elements, said at least one award selected from the group consisting of: a number of credits, a monetary value, a symbol, and a secondary event;

causing the processor to operate with a memory device to store the game information;

causing the processor to operate with a display device to display the plurality of player selectable elements;

causing the processor to operate with an input device to receive at least one player selection of at least one of the player selectable elements;

causing the processor to operate with the display device to display a destruction of the at least one selected player selectable element;

causing the processor to determine if the at least one selected player selectable element is associated with the secondary event;

if the at least one selected player selectable element is associated with the secondary event:

(a) causing the processor to select at least one other non-destroyed player selectable element based on a proximity algorithm configured to select the at least one other non-destroyed player selectable element based on a distance of the at least one other non-destroyed player selectable element from the at least one selected player selectable element, wherein:

(i) a first non-destroyed player selectable element that is a first distance from the selected player selectable element has a first probability of less than one hundred percent and greater than zero percent of being selected by the processor as the at least one non-destroyed player selectable element, and (ii) a second non-destroyed player selectable element that is a second, different distance from the selected player selectable element has a second, different probability of less than one hundred percent and greater than zero percent of being selected by the processor as the at least one non-destroyed player selectable element, and (b) causing the processor to operate with the display device to display a destruction of the selected at least one other non-destroyed player selectable element; and causing the processor to operate with the display device to reveal any award associated with each destroyed player selectable element.

2. The method of claim 1, which includes causing the processor to operate with the display device to display a concurrent entertainment theme.

3. The method of claim 1, which includes causing the processor to select the at least one other non-destroyed player selectable element based on the proximity algorithm and based on a display of debris resulting from the destruction of the at least one selected player selectable element.

4. The method of claim 1, which includes causing the processor to operate with the display device to display the destruction of the at least one selected player selectable element and the destruction of the selected at least one non-destroyed player selectable element as one or more simulated explosions.

5. The method of claim 4, which includes causing the processor to operate with the display device to display the one or more simulated explosions as destroying one or more simulated objects.

6. The method of claim 1, wherein the destruction of at least one of the player selectable elements includes a chain reaction destruction of at least one of the other non-destroyed player selectable elements.

7. The method of claim 1, wherein the at least one award associated with at least one of the player selectable elements includes a plurality of designated symbols, and which includes providing a designated award to the player if all of the designated symbols are revealed.

8. The method of claim 1, wherein the selected at least one other non-destroyed player selectable element includes at least one selected from the group consisting of: a player selectable element which is adjacent to the at least one selected player selectable element and a player selectable element which is adjacent to the at least one selected player selectable element but is not yet destroyed.

9. The method of claim 1, wherein a designated number of other non-destroyed player selectable elements are destroyed, said designated number determined based on at least one selected from the group consisting of: a size of a player wager and a player wager frequency.

10. The method of claim 1, which includes:

causing the processor to determine if the player wins a progressive jackpot, said determination being based on one or more destroyed player selectable elements; and awarding the player the progressive jackpot if the determination is that the player wins the progressive jackpot.

11. The method of claim 1, which includes awarding the player a progressive jackpot having an amount based on any player selectable elements which are destroyed.

12. The method of claim 1, which includes causing the processor to operate with at least two display devices to display the player selectable elements which are destroyed to at least two different players.

13. The method of claim 12, wherein at least one award associated with at least one player selectable element includes a shared award that is configured to be shared by a plurality of players.

14. The method of claim 13, wherein the shared award is a progressive award.

15. The method of claim 14, wherein a progressive award value of the progressive award is incremented based on any selected player selectable elements.

16. The method of claim 14, wherein a progressive award value of the progressive award is incremented based on any player selectable elements which are destroyed.

17. The method of claim 14, wherein the progressive award includes a mystery type progressive award.

18. A method of operating a gaming device, said method comprising:

causing a processor to generate game data for at least one wagering game, the game data including:

(a) data indicative of a plurality of player selectable selections, (b) data indicative of one or more awards associated with one or more of the player selectable selections, and (c) data indicative of at least one random chain reaction associated with at least one designated player selectable selection and at least one other player selectable selection, wherein the processor selects the at least one other player selectable selection based on a proximity of the at least one other player selectable selection to the at least one designated player selectable selection, wherein:

(i) a first one of the player selectable selections that is a first distance from the at least one designated player selectable selection has a first probability of less than one hundred percent and greater than zero percent of being selected by the processor as the at least one other player selectable selection, and (ii) a second one of the player selectable selections that is a second, different distance from the at least one designated player selectable selection has a second, different probability of less than one hundred percent and greater than zero percent of being selected by the processor as the at least one other player selectable selection;

causing the processor to operate with a memory device to store the game data;

causing the processor to operate with a display device to display the plurality of player selectable selections to a player;

causing the processor to operate with an input device to receive a player selection of one of the player selectable selections;

responsive to the player selection, causing the processor to operate with the display device to display a first destructive event associated with the selected player selectable selection;

if the selected player selectable selection includes the at least one designated player selectable selection, causing the processor to operate with the display device to display one or more additional destructive events representing the at least one random chain reaction, said one or more additional destructive events being associated with the at least one other player selectable selection, for each of any displayed destructive events, causing the processor to operate with the display device to reveal any symbols associated with said destructive event; and providing any awards to the player, said awards being based on any revealed symbols.

19. The method of claim 18, which includes:

causing the processor to determine an available number of player selectable selections;

causing the processor to associate the available number of player selectable selections with the data indicative of at least one random chain reaction; and causing the processor to update the available number of player selectable selections after each player selection.

20. The method of claim 18, wherein the destructive event is selected from the group consisting of: a detonation effect, a pyrotechnic effect, an acidic effect, and an effect associated with a theme of the wagering game.

21. The method of claim 18, which includes causing the processor to operate with a speaker to audibly broadcast an audio clip, said audio clip being associated with at least one displayed destructive event.

22. The method of claim 18, which includes:

causing the processor to provide at least one bonus round during the wagering game; and causing the processor to retrieve the game data from the memory device during the at least one bonus round.

23. The method of claim 18, which includes:

causing the processor to operate with the display device to display the wagering game as including a grid having a plurality of masked elements;

causing the processor to associate any destructive events with the plurality of masked elements; and causing the processor to operate with the display device to reveal at least one masked element and another nonadjacent masked element in association with at least one destructive event associated with the data indicative of at least one random chain reaction in response to the player selection.

24. The method of claim 18, which includes causing the processor to generate game data for at least one wagering game played by a second player.

25. The method of claim 18, which includes:

causing the processor to determine if the player wins a player progressive jackpot, said determination being based on any selected player selectable selections;

and awarding the progressive jackpot to the player if the determination is that the player wins the progressive jackpot.

26. The method of claim 18, which includes awarding a progressive jackpot having a progressive jackpot award amount based on any revealed symbols.

27. The method of claim 18, which includes causing the processor to operate with at least two different display devices to display at least one same destructive event to at least two different players.

28. The method of claim 27, wherein any awards are shared awards, and which includes providing a portion of any shared awards to at least two players of a plurality of players.

29. The method of claim 28, wherein the shared award is a progressive award.

30. The method of claim 29, which includes incrementing the progressive award based on any player selectable selection selected by any of the players of the group of players.

31. The method of claim 29, where the shared award is a progressive award, and which includes incrementing the progressive award based on any amount bet by one or more players of the group of players.

32. The method of claim 29, wherein the progressive award includes a mystery type progressive award.

33. A gaming machine comprising:

at least one display device;

at least one input device; and at least one controller including at least one processor and at least one memory, wherein:

(a) the at least one processor is configured to generate game data, the game data including data indicative of a plurality of player selectable selections and data indicative of at least one random chain reaction, wherein the data indicative of at least one random chain reaction is associated with at least one designated player selectable selection and at least one other player selectable selection, wherein the processor selects the at least one other player selectable selection based on a proximity algorithm configured to select the at least one other player selectable selection based on a distance of the at least one other player selectable selection from the designated player selectable selection, wherein:

(i) a first one of the player selectable selections that is a first distance from the at least one designated player selectable selection has a first probability of less than one hundred percent and greater than zero percent of being selected by the processor as the at least one other player selectable selection, and (ii) a second one of the player selectable selections that is a second, different distance from the at least one designated player selectable selection has a second, different probability of less than one hundred percent and greater than zero percent of being selected by the processor as the at least one other player selectable selection, and (b) the at least one memory is configured to store the game data, wherein in response to at least one player selection of at least one of the player selectable selections with the at least one input device, if the at least one selected player selectable selection is the designated player selectable selection, the controller initiates a destructive display on the at least one display device, wherein the destructive display is associated with the data indicative of at least one random chain reaction, wherein the destructive display includes a destruction of the designated player selectable selection and the at least one other player selectable selection, and wherein the controller provides a player any awards based on the destructive display.

34. The gaming machine of claim 33, wherein the at least one display device is configured to display an aftermath of the destructive display, said aftermath including a revelation of at least one award.

35. The gaming machine of claim 33, wherein a portion of the wagering game is configured and displayed as a grid having a plurality of masked elements, each masked element being associated with one of the player selectable selections, wherein, responsive to a player selection of at least one masked element, if the at least one player selection is associated with the designated player selectable selection, the destructive display and an aftermath reveals at least one award hidden by a masked element of the grid.

36. The gaming machine of claim 35, wherein the destructive display and the aftermath result in a revelation of at least two nonadjacent masked elements of the grid.

37. The gaming machine of claim 33, wherein the display device is configured to display a wagering game, the wagering game including a bonus round.

38. The gaming machine of claim 37, wherein:

the bonus round includes the plurality of player selectable selections and a set of hidden symbols, if a quantity of available player selectable selections decreases to a predetermined quantity, the bonus round ends, and if a predetermined quantity of the set of hidden symbols are revealed, the bonus round ends.

39. The gaming machine of claim 33, which includes a progressive jackpot controller, the progressive jackpot controller configured to award a progressive jackpot to the player based on the player selection.

40. The gaming machine of claim 33, wherein the controller is further configured to award a progressive jackpot having an amount determined based on any awarded symbols.

41. The gaming machine of claim 33, which includes a plurality of display devices, and wherein the destructive event is simultaneously displayed on more than one of the display devices.

42. The gaming machine of claim 41, wherein any awarded credits are shared by at least two players.

43. The gaming machine of claim 33, wherein the awarded credits are in the form of a progressive award.

44. The gaming machine of claim 43, where the progressive award is incremented based on the at least one player selection.

45. The gaming machine of claim 43, wherein the progressive award is incremented based on an amount bet by the player.

46. The gaming machine of claim 43, wherein the progressive award includes a mystery type progressive award.

47. The method of claim 1, wherein the second, different distance is greater than the first distance, and the first probability is greater than the second, different probability.

48. The method of claim 18, wherein the second, different distance is greater than the first distance, and the first probability is greater than the second, different probability.

49. The method of claim 33, wherein the second, different distance is greater than the first distance, and the first probability is greater than the second, different probability.

* * * * *

UNITED STATES PATENT AND TRADEMARK OFFICE

CERTIFICATE OF CORRECTION

PATENT NO. : 8,043,153 B2
APPLICATION NO. : 11/318343
DATED : October 25, 2011
INVENTOR(S) : Mark Ross et al.

It is certified that error appears in the above-identified patent and that said Letters Patent is hereby corrected as shown below:

Claim 1, column 16, line 55, between “at least one” and “non-” add --other--.

Claim 1, column 16, line 62, between “at least one” and “non-destroyed” add --other--.

Claim 4, column 17, line 15, between “at least one” and “non-” add --other--.

Claim 6, column 17, line 24, between “one of the” and “other” add --at least one--.

Claim 6, column 17, line 25, replace “elements” with --element--.

Claim 7, column 17, line 27, between “associated with” and “at least one” add --the--.

Claim 7, column 17, line 27, replace “elements” with --element--.

Claim 13, column 17, line 56, between “wherein” and “at least” add --the--.

Claim 13, column 17, line 57, between “with” and “at” add --the--.

Claim 24, column 19, line 23, between “generate” and “game data” add --the--.

Claim 24, column 19, line 23, between “one” and “wagering” add --second--.

Claim 30, column 19, line 35, replace “group” with --plurality--.

Claim 31, column 19, line 49, replace “group” with --plurality--.

Claim 33, column 20, line 26, between “of” and “at” add --the--.

Claim 33, column 20, line 2, between “the” and “designated” add --at least one--.

Signed and Sealed this
Twenty-first Day of August, 2012

David J. Kappos

David J. Kappos
*Director of the United States Patent and Trademark Office*

Claim 33, column 20, line 23, between “the” and “designated” add --at least one--.

Claim 33, column 20, line 28, between “the” and “designated” add --at least one--.

Claim 35, column 20, lines 38-39, replace “a portion of the wagering game is configured and” with --the game data includes--.

Claim 35, column 20, line 42, replace “a” with --at least one--.

Claim 35, column 20, line 44, between “the” and “designated” add --at least one--.

Claim 41, column 21, line 2, replace “event” with --display--.

Claim 42, column 21, line 5-6, replace “awarded credits” with --awards--.

Claim 43, column 21, line 7-8, replace “awarded credits” with --awards--.